US009682266B2

(12) United States Patent
Arzola et al.

(10) Patent No.: US 9,682,266 B2
(45) Date of Patent: Jun. 20, 2017

(54) TRAINING DEVICES, METHODS AND SYSTEMS

(71) Applicant: Chute Trainer Inc., Pocatello, ID (US)

(72) Inventors: Ruben Arzola, Chubbuck, ID (US); Rory Erchul, Pocatello, ID (US); Jennifer Erchul, Pocatello, ID (US); Jose L. Arzola, Jr., Pocatello, ID (US)

(73) Assignee: CHUTE TRAINER, LLC, Pocatello, ID (US)

( * ) Notice: Subject to any disclaimer, the term of this patent is extended or adjusted under 35 U.S.C. 154(b) by 0 days.

(21) Appl. No.: 14/853,983

(22) Filed: Sep. 14, 2015

(65) Prior Publication Data

US 2016/0074728 A1 Mar. 17, 2016

Related U.S. Application Data

(60) Provisional application No. 62/050,320, filed on Sep. 15, 2014.

(51) Int. Cl.
*A63B 69/36* (2006.01)
*A63B 21/008* (2006.01)
(Continued)

(52) U.S. Cl.
CPC ..... *A63B 21/0088* (2013.01); *A63B 21/0004* (2013.01); *A63B 21/0602* (2013.01); *A63B 21/4019* (2015.10); *A63B 21/4043* (2015.10); *A63B 69/002* (2013.01); *A63B 69/0079* (2013.01); *A63B 69/3632* (2013.01); *A63B 69/3638* (2013.01); *A63B 69/38* (2013.01); *A63B 2043/001* (2013.01);
(Continued)

(58) Field of Classification Search
USPC ..... 473/222, 223, 226, 228, 229, 256, 437, 473/451
See application file for complete search history.

(56) References Cited

U.S. PATENT DOCUMENTS 4,150,821 A * 4/1979 Racz ..... A63B 69/38 473/464
5,005,833 A * 4/1991 Groveman ..... A63B 69/38 273/DIG. 30

(Continued)

OTHER PUBLICATIONS

Simple Solution Productions, Power Throw Parachute, Published Aug. 1, 2013, Screenshots from a YouTube video from: https://www.youtube.com/watch?v=GAFAMSDOobl, other info. unknown.

(Continued)

*Primary Examiner* — Nini Legesse
(74) *Attorney, Agent, or Firm* — Flaig Law Office, PLLC; Jason E. Flaig

(57) ABSTRACT

Training devices, methods of using training devices and systems involving training devices are described. Training devices may include an attachment unit which includes a swivel, a plurality of support members, a first member and a second member. A training device may be configured to a first device, the first device may be moved with the training device configured to it in a desired motion and in as many repetitions as desired, and the training device may be removed from the first device. Training devices may be used in conjunction with hand units, strap units and other devices and/or appendages.

18 Claims, 16 Drawing Sheets

(51) Int. Cl.

| | |
|---|---|
| *A63B 69/00* | (2006.01) |
| *A63B 69/38* | (2006.01) |
| *A63B 21/00* | (2006.01) |
| *A63B 21/06* | (2006.01) |
| *A63B 43/00* | (2006.01) |

(52) U.S. Cl.
CPC ... *A63B 2069/0008* (2013.01); *A63B 2209/10* (2013.01); *A63B 2210/50* (2013.01)

(56) References Cited

U.S. PATENT DOCUMENTS

| | | | | |
|---|---|---|---|---|
| 5,207,625 | A * | 5/1993 | White | A63B 21/00069 473/228 |
| 5,348,292 | A | 9/1994 | Norman, Sr. | |
| 5,472,394 | A * | 12/1995 | Michaelson | A63B 21/0088 244/142 |
| 5,803,838 | A * | 9/1998 | DeMarini | A63B 21/0088 244/142 |
| 7,384,344 | B2 * | 6/2008 | Aguirre | A63B 15/00 473/219 |
| 7,632,192 | B2 * | 12/2009 | Begert | A63B 21/0004 473/215 |
| 7,762,929 | B1 * | 7/2010 | Celone | A63B 21/0088 482/109 |
| 7,951,020 | B2 | 5/2011 | Castor et al. | |
| 7,955,197 | B2 | 6/2011 | Roudybush | |
| 8,202,204 | B2 * | 6/2012 | Celone | A63B 21/0088 116/174 |
| D709,975 | S * | 7/2014 | Estrada, Jr. | D21/722 |
| 9,199,152 | B2 * | 12/2015 | Phillips | A63B 69/3632 |
| 2005/0159232 | A1 * | 7/2005 | Mackay | A63B 21/0552 473/219 |
| 2006/0135291 | A1 | 6/2006 | Biegen | |
| 2006/0189417 | A1 * | 8/2006 | Evans | A63B 69/002 473/446 |
| 2007/0087868 | A1 * | 4/2007 | Williams | A63B 69/0059 473/464 |
| 2007/0129159 | A1 * | 6/2007 | Koncelik | A63B 69/36 473/226 |
| 2007/0275796 | A1 * | 11/2007 | Carter | A63B 69/38 473/459 |
| 2008/0161167 | A1 * | 7/2008 | Ottaviani | A63B 69/12 482/55 |
| 2012/0015783 | A1 * | 1/2012 | Brown | A63B 21/0004 482/74 |
| 2014/0243170 | A1 * | 8/2014 | Shiozaki | A63B 21/0088 482/111 |

OTHER PUBLICATIONS

Idaho Power Sports, Screenshot from: http://www.pikore.com/idaho_power_sports, see Ex's C-M for screenshots & publication dates of specific links on Ex.B, other info. unknown.
Idaho Power Sports, Published Jan. 6, 2014, Screenshot from: http://www.pikore.com/m/627872097296523212_785778910, other information unknown, accessed Dec. 14, 2015.
Idaho Power Sports, Published Dec. 24, 2013, Screenshot from: http://www.pikore.com/m/618510636950560335_785778910, other information unknown, accessed Dec. 14, 2015.
Idaho Power Sports, Published Dec. 10, 2013, Screenshot from: http://www.pikore.com/m/608328330323500262_785778910, other information unknown, accessed Dec. 14, 2015.
Idaho Power Sports, Published Dec. 10, 2013, Screenshot from: http://www.pikore.com/m/608310812024315866_785778910, other information unknown, accessed Dec. 14, 2015.
Idaho Power Sports, Published Dec. 10, 2013, Screenshot from: http://www.pikore.com/m/608310539763654613_785778910, other information unknown, accessed Dec. 14, 2015.
Idaho Power Sports, Published Dec. 10, 2013, Screenshot from: http://www.pikore.com/m/608310188843016141_785778910, other information unknown, accessed Dec. 14, 2015.
Idaho Power Sports, Published Dec. 10, 2013, Screenshot from: http://www.pikore.com/m/608309725431144385_785778910, other information unknown, accessed Dec. 14, 2015.
Idaho Power Sports, Published Dec. 10, 2013, Screenshot from: http://www.pikore.com/m/608307188799971220_785778910, other information unknown, accessed Dec. 14, 2015.
Idaho Power Sports, Published Dec. 10, 2013, Screenshot from: http://www.pikore.com/m/608306799233015694_785778910, other information unknown, accessed Dec. 14, 2015.
Idaho Power Sports, Published Dec. 10, 2013, Screenshot from: http://www.pikore.com/m/608306371732774794_785778910, other information unknown, accessed Dec. 14, 2015.
Idaho Power Sports, Published Dec. 10, 2013, Screenshot from: http://www.pikore.com/m/608305800216911743_785778910, other information unknown, accessed Dec. 14, 2015.
Internet Archive Wayback Machine, Published Jan. 4, 2014, Screenshots from: https://web.archive.org/web/20140104041212/http:/www.parachutepower.com/, other information unknown.

* cited by examiner

TRAINING DEVICES, METHODS AND SYSTEMS

BACKGROUND

Technical Field

The disclosure relates to training devices, methods and systems.

Discussion of Related Field

Many people engage various training devices, methods and systems aimed at developing a particular skill. For example, golfers may go to the driving range and practice their swing, baseball players may go to the practice field to practice hitting baseballs, tennis players may hire a trainer to help them perfect their swing, softball pitchers may have another person catch their pitches in order to help them develop as a pitcher, etc.

Individuals may lift weights or engage resistance machines in order to build muscle, strength, endurance and speed. The costs of weights, resistance machines and/or gym or club memberships can be considerable. In addition, weights and resistance machines may not track or follow the natural range of motion of a particular activity (such as, for example, swinging a golf club or bat or throwing a football or softball) and/or do not naturally increase resistance as a user's strength increases. Some resistance machines attempt to simulate the natural range of motion, but either require fixed devices (such as, for example, bungee cords, throwing wheels) lack portability and compactness, and/or require significant set up time, which make them undesirable. Some training devices, methods and systems can only be performed in certain environments and in conjunction with certain activities.

In light of the foregoing discussion, there may be a need for improved training devices, methods and systems which may be easy to use, portable, compact, light, and do not require significant set up time. There may be a need for training devices, methods and systems that strengthen a user's muscles, promote endurance and increase speed, while at the same time simulating a user's natural motion of the desired exercise and naturally increasing resistance as a user's strength increases. There may be a need for training devices, methods and systems that may be used to development multiple skills in a variety of settings.

CROSS-REFERENCES TO RELATED APPLICATION

This application claims the benefit of and priority to:

Pending prior U.S. Provisional Application No. 62/050,320, filed on Sep. 15, 2014, which is entitled "CHUTE TRAINER".

The entire content of the above document is hereby incorporated herein by reference as part of this application.

SUMMARY

In one aspect, a training device may include an attachment unit which includes a swivel; a plurality of support members; a first member; and a second member.

Implementations may also include one or more of the following features. The plurality of support members may include at least three support legs. The plurality of support members may further include a neck member; and a chute support member. The at least three support legs, the neck member and the chute support member may be configured from at least one of the following materials: polypropylene nylon binding tape, nylon blend woven webbing, polypropylene, nylon, nylon blend, cotton, nylon-woven, polyester, elastic, rubber and jacquard. The first member may include an opening. The first member may be configured from at least one of the following materials: nylon football mesh, woven nylon football mesh, fabric football mesh, polyester mesh, cotton football mesh, cotton-poly football mesh, double knit mesh, air-wick mesh, dazzle mesh, moisture wicking polyester mesh, dazzle cloth polyester, and air wicking hybrid mesh. The first member may be configured to be between about 12 inches to about 20 inches wide. The second member may be configured from at least one of the following materials: nylon rip stop, cotton rip stop, polyester rip stop, woven rip stop, silk rip stop, and polypropylene. The second member may be configured from material that includes cross-hatched threading.

Implementations may also include one or more of the following features. The plurality of support members may include at least four support legs. The plurality of support members may further include a neck member; and a chute support member. The at least four support legs, the neck member and the chute support member may be configured from at least one of the following materials: polypropylene nylon binding tape, nylon blend woven webbing, polypropylene, nylon, nylon blend, cotton, nylon-woven, polyester, elastic, rubber and jacquard. The first member may include an opening. The first member may be configured from at least one of the following materials: nylon football mesh, woven nylon football mesh, fabric football mesh, polyester mesh, cotton football mesh, cotton-poly football mesh, double knit mesh, air-wick mesh, dazzle mesh, moisture wicking polyester mesh, dazzle cloth polyester, and air wicking hybrid mesh. The first member may be configured to be between about 26 inches to about 34 inches wide. The second member may be configured from at least one of the following materials: nylon rip stop, cotton rip stop, polyester rip stop, woven rip stop, silk rip stop, and polypropylene. The second member may be configured from material that includes cross-hatched threading.

In another aspect a method of using a training device may include: a training device may include an attachment unit which includes a swivel; a plurality of support members; a first member; and a second member; wherein the training device may be configured to a first device; wherein the first device is moved with the training device configured to it in a desired motion and in as many repetitions as desired; and wherein the training device is removed from the first device.

In another aspect a method of using a training device with a hand unit may include: a training device, which may include an attachment unit which includes a swivel; a plurality of support members; a first member; and a second member; and a hand unit, which may include at least two strap members; and optionally, a first device; and configuring the hand unit to the training device; inserting at least one of the user's fingers into the hand unit; optionally, engaging the first device; moving the hand unit configured to the training device in a desired motion and in as many repetitions as desired, and optionally, while engaging the first device; optionally, releasing the first device; removing the user's fingers from the hand unit; and optionally, removing the hand unit from the training device.

In another aspect a method of using a training device with a strap unit may include: a training device, which may include an attachment unit which includes a swivel; a plurality of support members; a first member; and a second member; and a strap unit, which may include: a bottom surface; and a top surface; and a first device; and configuring the strap unit to the training device; configuring the strap unit to the first device; moving the first device with the strap unit configured to it in a desired motion and in as many repetitions as desired; removing the strap unit from the first device; and optionally, removing the strap unit from the training device.

These general and specific aspects may be implemented by using systems, apparatuses, devices, means, methods and structures or any combination thereof.

Certain implementations may provide one or more of the following advantages. Embodiments may not achieve any or all of the listed advantages. Further, this is not an exhaustive list of all possible advantages of the disclosure. One or more embodiment of the disclosure may be configured to be and/or provide users the following.

In one or more embodiments, the disclosure may provide portability and mobility, increase strength, and utilize wind resistance. In one or more embodiments, the disclosure may be lightweight, compactable, and easy to use. In one or more embodiments, the disclosure may be universally used by men, women, and children of any ability, any age. In one or more embodiments, the disclosure may be used with a variety of desired motions, activities and devices (such as, for example, on any standard golf shaft, bat, etc.).

In one or more embodiments, the disclosure may be transported and used by users in many settings where there is sufficient space available to carry out the specific training motion the user desires to engage in. For example, in one or more embodiments, a golfer may use the disclosure on a golf course, at a park, in a back yard, in a garage, etc. In one or more embodiments, the disclosure may be used year-round, indoors or outdoors.

In one or more embodiments, the disclosure may allow users to retain the natural trajectory or motion of the particular motion they are practicing while using the disclosure. For example, in one or more embodiments, the disclosure may allow users to perform their natural motion while swinging a golf club, swinging a baseball or softball bat or engaging in a throwing motion.

In one or more embodiments, the disclosure may use wind resistance to strengthen a user's muscles and aid the user in developing his or her skill in performing the desired motion. In one or more embodiments, the disclosure may be intended to enhance arm and shoulder strength, including the muscles of the rotator cuff. In one or more embodiments, the disclosure's use of natural wind resistance may increase a user's strength by targeting fast twitch muscle fibers. In one or more embodiments, the disclosure may fire, prime and strengthen a user's fast twitch muscle fibers, build a user's explosive speed, and quicken a user's hands. In one or more embodiments, the disclosure may have minimal or no effect on a user's slow twitch muscle fibers.

In one or more embodiments, as a user's arm moves forward in a throwing motion, the disclosure may open and catch air, which may add wind resistance and therefore directly provide a workload to the fast twitch muscle fibers used in throwing. In one or more embodiments, the added resistance may build rotator cuff strength without changing the mechanics of the individual's throwing style. In one or more embodiments, the increase in strength allows an individual to throw an object (e.g. baseball, softball, football, Frisbee etc. . . . ) with a higher velocity and further distance. In one or more embodiments, in relation to the use of wind resistance (vs. weight resistance), throwing mechanics may not be impacted which may allow for the continued use of a consistent learned throwing motion. In one or more embodiments, the increase/decrease in resistance may be directly correlated with the user's ability/desire to perform the throwing motion with varying degrees of velocity (which may be the result of the use of a parachute type configuration), which may lead to an infinite amount of resistance levels. In one or more embodiments, as use of the disclosure may increase arm strength and a harder throwing motion is practiced and the chute may catch more air to which it may add more resistance, allowing the disclosure to adapt to the needs of each individual user. In one or more embodiments, the disclosure may be used to enhance both overhand and underhand throwing velocities.

In one or more embodiments, the disclosure may allow users to warm up without becoming fatigued and to quickly and easy warm up prior to engaging in a particular activity. In one or more embodiments, the disclosure may allow users to perform rehabilitation techniques. In one or more embodiments, the disclosure may provide a user strength conditioning training, strengthen a user's core muscles, and promote hip rotation. In one or more embodiments, the disclosure may build a user's swing endurance and promote a user's swing and throw strength. In one or more embodiments, the disclosure may be low impact.

In one or more embodiments, the disclosure may be used without adding increased weight to the user's motion of exercise. In one or more embodiments, the disclosure may minimize the stress on a user's ligaments and tendons. In one or more embodiments, the disclosure may increase the explosiveness and speed of a user's choice of motion. In one or more embodiments, the disclosure may increase resistance as a user's ability also increases. As the user's strength develops, in one or more embodiments, the disclosure may adapt to the increased demand without the need to purchase additional equipment.

In one or more embodiments, the disclosure may allow users to use their natural mechanics when engaging in their desired practice motion without impedance from the disclosure (except for wind resistance). In one or more embodiments, the disclosure may be used without being attached to a fixed object (such as, for example, a wall) which may allow the disclosure to be used in multiple settings and environments.

In one or more embodiments, the disclosure may increase a user's club head speed, bat speed, and throwing speed. In one or more embodiments, the disclosure may provide lag and teach a user lag. In one or more embodiments, the disclosure may teach a user proper swing sequence. In one or more embodiments, the disclosure may promote a user to follow through to the target when swinging a device. In one or more embodiments, the disclosure may teach proper arch. In one or more embodiments, the disclosure may help correct a slice or hook resulting from a golf swing. In one or more embodiments, the disclosure may fit in golf bag or pocket and to be easy to transport. In one or more embodiments, the disclosure may attach and detach from clubs and be non-marring, such as, for example, it may not scratch a club shaft.

Other features and advantages may be apparent from the following detailed description, the accompanying drawings, and the claims.

BRIEF DESCRIPTION OF THE DRAWINGS

Various embodiments of the disclosure will now be discussed with reference to the appended drawings. It is appreciated that these drawings depict only typical embodiments of the disclosure and are not to be considered limiting of its scope.

FIG. 12O shows a bottom view of one embodiment of a hand unit, including one embodiment of a means for configuring the hand unit to a training device.

DETAILED DESCRIPTION

Figure 1:
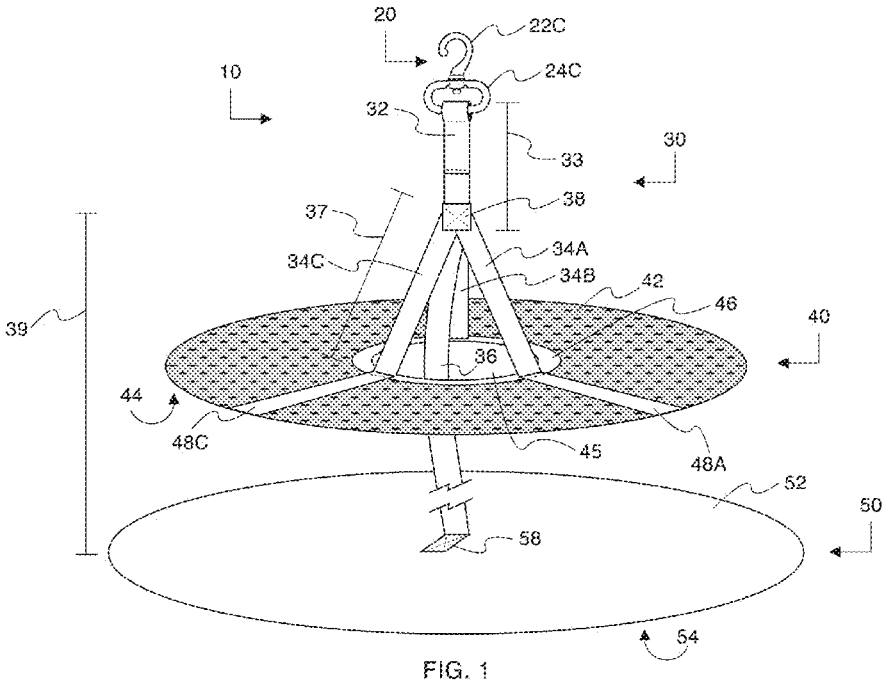
FIG. 1 shows a perspective view of one embodiment of aspects of a training device, which may include an attachment unit, a plurality of support members, a first member and a second member.

The following description illustrates principles of the disclosure which may be applied in various ways to provide different embodiments. There may be many different forms of embodiments of the disclosure, and as such, embodiments should not be limited to those set forth herein and shown in the accompanying drawings. That which is set forth herein and shown in the accompanying drawings is offered to illustrate the principles of the disclosure and one or more embodiments, and not as limitations. Other variations of the disclosure may be included within the principles of the disclosure.

In one or more embodiments, regardless of whether expressly stated herein or illustrated in the accompanying drawings, the disclosure may be configurable, adaptable and customizable to meet the various needs of various users in various circumstances and/or to be compatible and/or used in conjunction with various systems, methods and/or devices.

In one or more embodiments, a system and/or systems of using the disclosure may be used to implement none or some or all of the methods of using the disclosure.

In one or more embodiments, the disclosure may be configured in various ways, by various means and/or methods, with various components and/or parts, to various dimensions, and/or with various materials. For example, in one or more embodiments, the specific parts, members, devices, and/or components of the disclosure may be configured together, separate and/or with other parts, members, devices, and/or components by means of sewing, knitting, weaving, crocheting, melting, burning, gluing, cementing, adhering, pressing, cutting, lasering, hooking-looping (e.g. Velcroing), buttoning, buckling, zipping, snapping, knotting, strapping, fastening, roping, threading, stringing, tying, stitching, clamping, clipping, pinning, holing, hooking, pocketing, attaching, securing, connecting, pinching, cleaving, clinging, clasping, chaining, latching, shanking, welding, bolting, screwing, nailing, sticking, including releasable and/or not releasable configurations, breakaway and/or non-breakaway configurations, and any other materials, adhesives, devices, systems, means, and methods, and/or combinations thereof.

In one or more embodiments, the disclosure may be used for various uses and/or purposes. In one or more embodiments, the drawings herein may but do not necessarily illustrate the disclosure to scale and nor do they necessarily depict the exact positions, sizes, shapes, dimensions, layouts, designs, and/or other configurations in which the disclosure may be implemented.

FIGS. 1 through 4B show one or more embodiments of training device 10. The embodiments of training device 10 illustrated in FIGS. 1 through 4B may be used in conjunction with a variety of devices and/or combinations of devices (generically referred to in FIGS. 13, 16, and 18 as "first device") and activities. For example, in one or more embodiments, training device 10 may be used in conjunction with and/or to promote the use of devices and/or sporting or other activities which may include the use of a handle, club, shaft, rod or stick-like element, such as, for example, golf clubs (such as, for example, illustrated in FIGS. 14A and 14B), tennis rackets, bats, hockey sticks, sword fighting, axe-throwing, axing, pickle ball, racquetball, badminton, cricket, lacrosse, polo, table tennis, squash, and the like and other activities. In another example, in one or more embodiments, training device 10 may be used in conjunction with and/or to promote the use of devices and/or sporting or other activities which may include a swinging, kicking, hitting, stroking, throwing (such as, for example, illustrated in FIG. 17C) or other motion(s), such as, for example, baseball, softball, football, rugby, handball, wallyball, dodgeball, volleyball, Frisbee, disc golf discs, soccer, kickball, javelin, discus, shotput, boxing, kickboxing, martial arts, swimming, and bowling, and the like and other activities. In another example, in one or more embodiments, training device 10 may be used in conjunction with human and/or artificial appendages, such as, for example, a user's fingers (such as, for example, illustrated in FIG. 17C), hands, legs, arms, etc. The embodiments of training device 10 illustrated in FIGS. 1 through 4B may variety in weight, such as, for example, training device 10 may weigh about 0.10 ounce to about 6 ounces (e.g. about 1.3 ounces).

FIG. 1 shows one embodiment of a training device 10 which may include an attachment unit 20, a plurality of support members 30, a first member 40, and a second member 50. Attachment unit 20, support members 30, first member 40, and second member 50 may be configured to various dimensions, from various materials, with various parts, for various reasons.

In one or more embodiments, attachment unit 20 may include one or more means, materials and/or methods for being releasably and/or not releasably attached, secured, fastened, connected, clamped, pinched, buttoned, buckled, snapped, strapped, zipped, hooked, cleaved, clung, clasped, chained, clipped, latched, shanked, pinned, welded, tied, bolted, screwed, nailed, glued, stuck, adhered, melted, or otherwise configured to other portions of training device 10 and/or apparatuses other than training device 10. For example, as illustrated in FIG. 1, one or more embodiments of attachment unit 20 may include a hook member. More will be discussed about attachment units and hook members below.

In one or more embodiments, support members 30 may include one or more means, materials and/or methods for releasably and/or not releasably sewing, knitting, weaving, crocheting, melting, burning, gluing, cementing, adhering, pressing, cutting, lasering, hooking-looping (e.g. Velcroing), buttoning, buckling, zipping, snapping, knotting, strapping, fastening, roping, threading, stringing, tying, stitching, clamping, clipping, pinning, holing, hooking, pocketing, attaching, securing, connecting, pinching, cleaving, clinging, clasping, chaining, latching, shanking, welding, bolting, screwing, nailing, sticking, including releasable and/or not releasable configurations, breakaway and/or non-breakaway configurations, and any other materials, adhesives, devices, systems, means, and methods, and/or combinations thereof, or otherwise configuring attachment unit 20 to first member 40 and/or to second member 50 and/or to other devices. In one or more embodiments, support members 30 may include a neck member 32, at least three support legs 34A, 34B, 34C, and a chute support member 36, which may be configured to various dimensions, from various materials, with various parts, for various reasons.

For example, in one or more embodiments, neck member 32, the at least three support legs 34A, 34B, 34C and chute support member 36 may be configured from the same or similar or different various materials (such as, for example, polypropylene nylon binding tape, nylon blend woven webbing, polypropylene, nylon, nylon blend, cotton, nylon-woven, polyester, elastic, eco-friendly, rubber, jacquard, reflective or the like or other materials). For example, in one or more embodiments, neck member 32 and the at least three support legs 34A, 34B, 34C may be configured from polypropylene nylon binding tape and chute support member 36 may be configured from nylon blend woven webbing. In one or more embodiments, neck member 32, the at least three support legs 34A, 34B, 34C and chute support member 36 may be configured from the same or similar or different widths (such as, for example, about ¼ of an inch to about 2 inches wide (e.g. about ¾ of an inch wide)). In one or more embodiments, neck member 32, may be about 1 inch to about 6 inches in length 33 (e.g. about 4½ inches in length 33) wherein some portion(s) of neck member 32 may be doubled back on itself or configured to other material or parts of training chute 10 for reinforcement or other purposes (e.g. for enabling configuration to other devices), which doubling back or configuration may reduce neck member's 32 length 33, such as, for example, to about 3¾ inches in length 33.

In one or more embodiments, the at least three support legs 34A, 34B, 34C and chute support member 36 may be configured and reinforced to neck member 32 at some location on neck member 32 by various means, materials and methods, such as, in one or more embodiments, by sewing the at least three support legs 34A, 34B, 34C and chute support member 36 to a bottom portion 38 of neck member 32.

In one or more embodiments, as illustrated in FIG. 1, first member 40 may include a top portion 42 and a bottom portion 44 (although bottom portion 44 is not shown on FIG. 1). In one or more embodiments, first member 40 may be configured from various materials, such as, for example, football mesh, nylon football mesh, woven nylon football mesh, fabric football mesh, polyester mesh (70, 80 or 90 denier), polyester mesh (150 denier), cotton football mesh, cotton-poly football mesh, double knit mesh, air-wick mesh, dazzle mesh, moisture wicking polyester mesh, dazzle cloth polyester, air wicking hybrids or the like or other materials. In one or more embodiments, first member 40 may be provided in virtually an unlimited number of colors.

In one or more embodiments, as illustrated in FIG. 1, second member 50 may include a top portion 52 and a bottom portion 54 (although bottom portion 54 is not shown on FIG. 1). In one or more embodiments, second member 50 may be configured from various materials, such as, for example, 70 denier black nylon rip stop, cotton rip stop, polyester rip stop, woven rip stop, silk rip stop, polypropylene, or the like or other materials, which may include cross-hatched threading. In one or more embodiments, second member 50 may be provided in virtually an unlimited number of colors.

In one or more embodiments, the at least three support legs 34A, 34B, 34C may be configured to first member 40 at some location on first member 40, such as, in one or more embodiments, top portion 42. In one or more embodiments, the length 37 of each of the at least three support legs 34A, 34B, 34C may be about 1 inch to about 10 inches (e.g. about 3 inches) from the point(s) at which they may be configured to top portion 42 (which may be points furthest from the outer edge of first member 40) to the point(s) they are configured to the bottom portion 38 of neck member 32.

In one or more embodiments, reinforcement of training device 10 may be provided. For example, as illustrated in FIG. 1, at least three support members 48A, 48B, 48C (although 48B is not shown in FIG. 1) may be provided which may align with and/or be the actual material of the at least three support legs 34A, 34B, 34C. In one or more embodiments, the at least three support members 48A, 48B, 48C may be made from the same or similar or different materials as the at least three support legs 34A, 34B, 34C (such as, for example, polypropylene nylon binding tape, nylon blend woven webbing, polypropylene, nylon, nylon blend, cotton, nylon-woven, polyester, elastic, eco-friendly, rubber, jacquard, reflective or the like or other materials) which may be about ¼ of an inch to about 2 inches wide (e.g. about ¾ of an inch wide). In one or more embodiments, the at least three support members 48A, 48B, 48C may be sewn to top portion 42 starting near one edge of the first member 40 and continuing until near the opposite edge of the first member 40 and back to the initial edge of first member 40 in any appropriate pattern. In one or more embodiments, the at least three support members 48A, 48B, 48C may be sewn to the particular at least three support legs 34A, 34B, 34C to which they are aligned.

In one or more embodiments, as illustrated in FIG. 1, the bottom portion 58 of chute support member 36 may be configured to second member 50 by various means, materials and methods, such as, in one or more embodiments, by sewing it to top portion 52.

In one or more embodiment, the length 39 of chute support member 36 may be about 4 inches to about 25 inches (e.g. about 11 inches) starting from the point at which it is configured to neck member 32 continuing until the point at which it is configured to top portion 52.

Figure 2A:
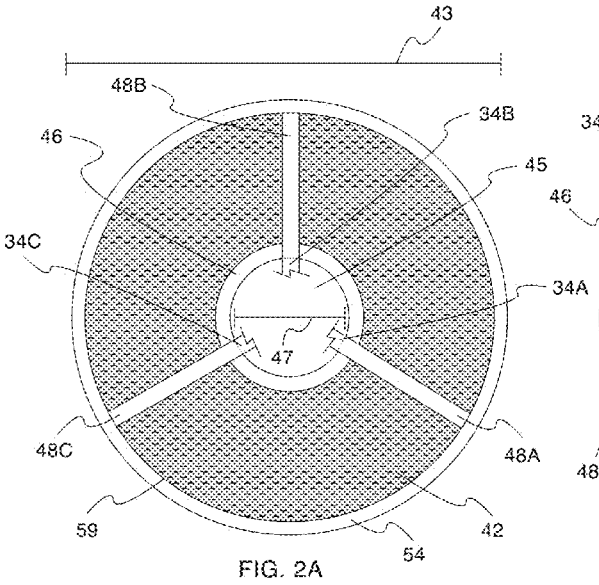
FIG. 2A shows a top view of one embodiment of aspects of a training device, including a first member.

FIG. 2A shows a top view of portions of one embodiment of training device 10. In one or more embodiments, first member 40 may be configured to be about 12 inches to about 20 inches in width 43 (e.g. about 16 inches in width 43), wherein some portion(s) of first member 40 may be doubled back on itself or configured to other material or parts of training chute 10 for reinforcement or other purposes, which may reduce first member's 40 width 43, such as, for example, to about 15 inches in width 43. In one or more embodiments, first member 40 may be configured with an opening, such as, for example, opening 45, which may be located approximately in the center of first member 40 which may be about 2 inches to about 6 inches in diameter 47 (e.g. about 4 inches in diameter 47). In one or more embodiments, reinforcement material 46 may be configured to at least some portion of the edge of the opening, such as, for example, the edge of opening 45. In one or more embodiments, reinforcement material 46 may be configured from various materials (such as, for example, polypropylene nylon binding tape, nylon blend woven webbing, polypropylene, nylon, nylon blend, cotton, nylon-woven, polyester, elastic, eco-friendly, rubber, jacquard, reflective or the like or other materials). In one or more embodiments, metal, plastic, rubber or other material may be configured to reinforcement material 46 so as to stiffen the opening and help ensure that it properly opens during use. FIG. 2A also shows one embodiment of the at least three support members 48A, 48B, 48C and aspects of the at least three support legs 34A, 34B, 34C.

Figure 2B:
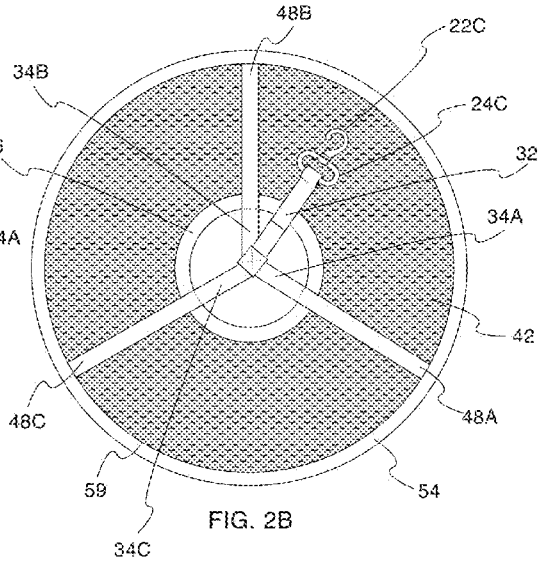
FIG. 2B shows a top view of one embodiment of additional aspects of the training device illustrated in FIG. 2A.

FIG. 2B shows the embodiment of training device 10 illustrated in FIG. 2A excepting that a fuller view of the at least three support legs 34A, 34B, 34C and attachment unit 20 are also shown.

Figure 3:
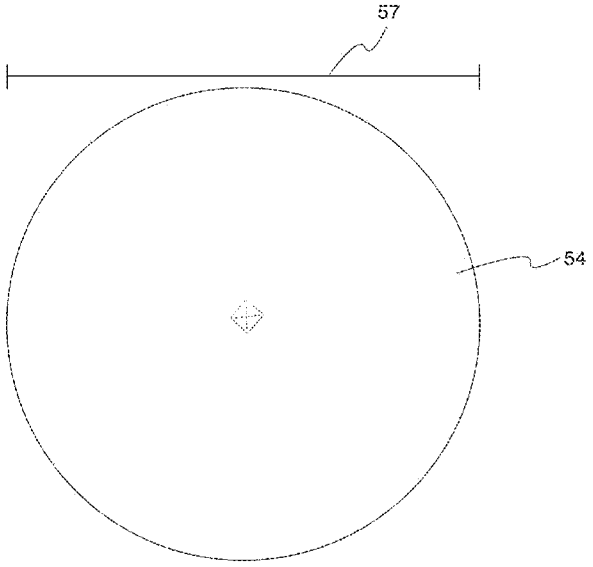
FIG. 3 shows a bottom view of one embodiment of aspects of a training device, including a second member.

FIG. 3 shows a bottom view of one embodiment of aspects of training device 10. In one or more embodiments, second member 50 may be configured to about 13 inches to about 21 inches in width 57 (e.g. about 17 inches in width 57), wherein some portion(s) of second member 50 may be doubled back on itself or configured to other material or parts of training chute 10 for reinforcement or other purposes, which may reduce second member's width 57, such as, for example, to about 16 inches in width 57. FIG. 3 shows one embodiment of sewing on the bottom portion 54 of second member 50 associated with sewing bottom portion 58 of chute support member 36 to top portion 52.

Figure 4A:
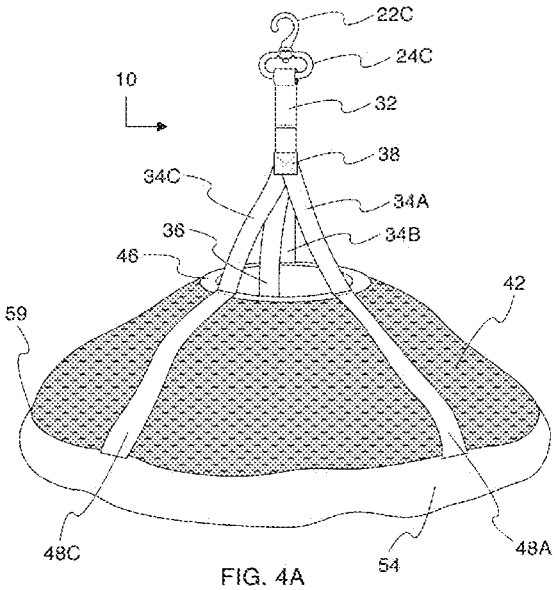
FIG. 4A shows a perspective view of one embodiment of aspects of a training device, including where a first member may be configured to a second member.

FIG. 4A is a perspective view of one embodiment of training device 10 wherein first member 40 is configured to second member 50 and wherein aspects of training device 10 is slightly raised. In one or more embodiments, first member 40 may be configured to second member 50 by various means, materials and methods, such as, for example, by sewing them together along or near the circumferences or edge of their respective exterior edges, such as, for example, at a location 59 where first member 40 and second member 50 may be configured together.

Figure 4B:
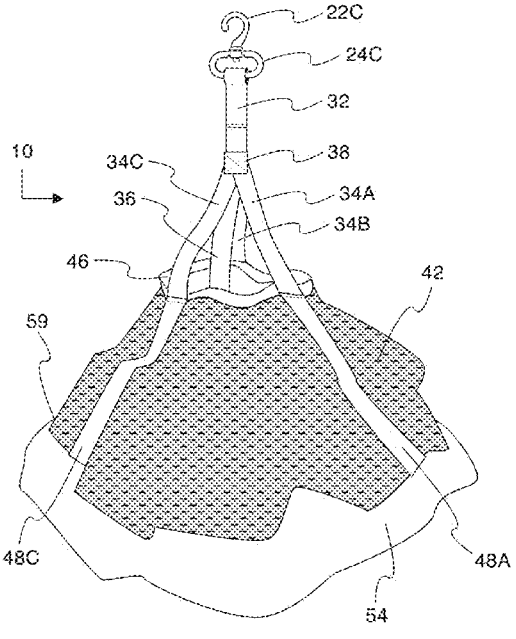
FIG. 4B shows a perspective view of the embodiment of aspects of the training device illustrated in FIG. 4A, with aspects of the training device being elongated.

FIG. 4B is a perspective view of the embodiment of training device 10 as illustrated in FIG. 4A, however, the training device 10 as shown in FIG. 4B has been elongated. At least one purpose of the view in FIG. 4B is to show that at least some of the material from which training device 10 may be configured may be flexible and malleable, making it easily storable, transportable and adaptable.

FIGS. 5 through 8B, show one or more embodiments of training device 10. In one or more embodiments, the configuration of the embodiments of training device 10 as illustrated in FIGS. 5 through 8B may be similar and/or different as compared to the configurations of the embodiments of training device 10 as illustrated in FIGS. 1 through 4B. In one or more embodiments, the one or more embodiments of training device 10 as illustrated in FIGS. 5 through 8B may be larger, stronger, configured with more reinforcement material and better suited for certain sporting or other activities (such as, for example, tennis (see FIGS. 15A and 15B), pitching and hitting warmups associated with softball, baseball, football, and hockey (see FIGS. 17D, 17E, 19C, 20A and 20B), as compared to the one or more embodiments of training device 10 as illustrated in FIGS. 1 through 4B.

The embodiments of training device 10 illustrated in FIGS. 5 through 8B may be used in conjunction with a variety of devices and/or combinations of devices (generically referred to in FIGS. 13, 16, and 18 as "first device") and activities. For example, in one or more embodiments, training device 10 may be used in conjunction with and/or to promote the use of devices and/or sporting or other activities which may include the use of a handle, club, shaft, rod or stick-like element, such as, for example, golf clubs, tennis rackets (such as, for example, illustrated in FIGS. 15A and 15B), bats (such as, for example, illustrated in FIGS. 19A, 19B and 19C), hockey sticks (such as, for example, illustrated in FIGS. 20A and 20B), sword fighting, axe-throwing, axing, pickle ball, racquetball, badminton, cricket, lacrosse, polo, table tennis, squash, and the like and other activities. In another example, in one or more embodiments, training device 10 may be used in conjunction with and/or to promote the use of devices and/or sporting or other activities which may include a swinging, kicking, hitting, stroking, throwing (such as, for example, illustrated in FIGS. 17D and 17E) or other motion(s), such as, for example, baseball, softball, football, rugby, handball, wallyball, dodgeball, volleyball, Frisbee, disc golf discs, soccer, kickball, javelin, discus, shotput, boxing, kickboxing, martial arts, swimming, and bowling, and the like and other activities. In another example, in one or more embodiments, training device 10 may be used in conjunction with human and/or artificial appendages, such as, for example, a user's fingers (such as, for example, illustrated in FIGS. 17D and 17E), hands, legs, arms, etc. The embodiments of training device 10 illustrated in FIGS. 5 through 8B may variety in weight, such as, for example, training device 10 may weigh about 0.10 ounce to about 12 ounces (e.g. about 4.4 ounces).

Figure 5:
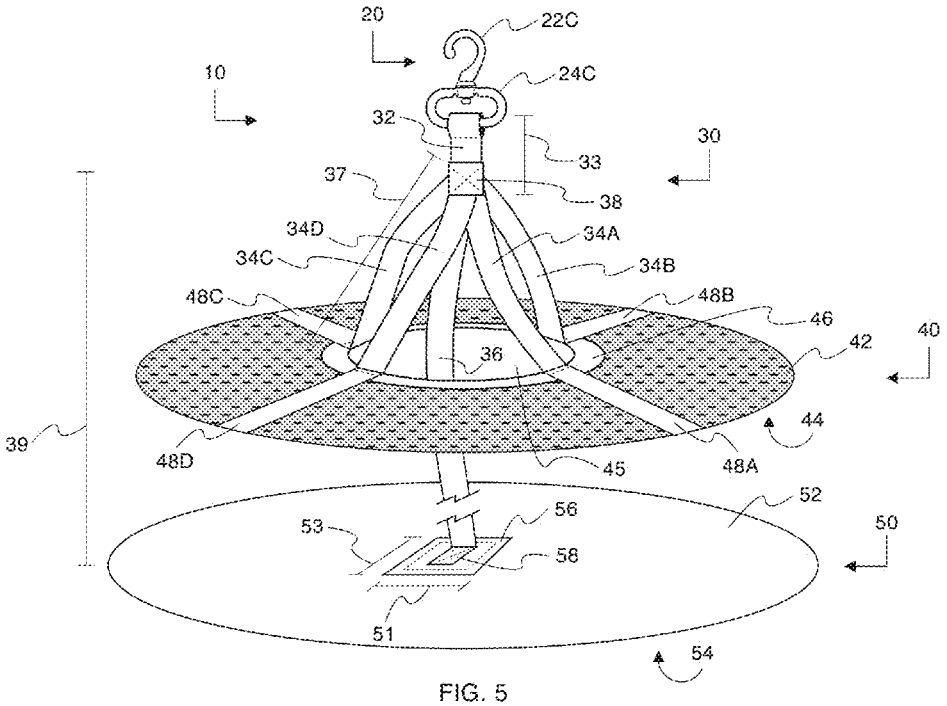
FIG. 5 shows a perspective view of another embodiment of aspects of a training device, which may include an attachment unit, a plurality of support members, a first member and a second member.

FIG. 5 shows one embodiment of training device 10 which may include an attachment unit 20, a plurality of support members 30, a first member 40, and a second member 50. Attachment unit 20, support members 30, first member 40, and second member 50 may be configured to various dimensions, from various materials, with various parts, for various reasons.

In one or more embodiments, attachment unit 20 may include one or more means, materials and/or methods for being releasably and/or not releasably attached, secured, fastened, connected, clamped, pinched, buttoned, buckled, snapped, strapped, zipped, hooked, cleaved, clung, clasped, chained, clipped, latched, shanked, pinned, welded, tied, bolted, screwed, nailed, glued, stuck, adhered, melted, or otherwise configured to other portions of training device 10 and/or apparatuses other than training device 10. For example, as illustrated in FIG. 5, one or more embodiments of attachment unit 20 may include a hook member. More will be discussed about attachment units and hook members below.

In one or more embodiments, support members 30 may include one or more means, materials and/or methods for releasably and/or not releasably sewing, knitting, weaving, crocheting, melting, burning, gluing, cementing, adhering, pressing, cutting, lasering, hooking-looping (e.g. Velcroing), buttoning, buckling, zipping, snapping, knotting, strapping, fastening, roping, threading, stringing, tying, stitching, clamping, clipping, pinning, holing, hooking, pocketing, attaching, securing, connecting, pinching, cleaving, clinging, clasping, chaining, latching, shanking, welding, bolting, screwing, nailing, sticking, including releasable and/or not releasable configurations, breakaway and/or non-breakaway configurations, and any other materials, adhesives, devices, systems, means, and methods, and/or combinations thereof, or otherwise configuring attachment unit 20 to first member 40 and/or to second member 50 and/or to other devices. In one or more embodiments, support members 30 may include a neck member 32, at least four support legs 34A, 34B, 34C, 34D, and a chute support member 36, which may be configured to various dimensions, from various materials, with various parts, for various reasons.

For example, in one or more embodiments, neck member 32, the at least four support legs 34A, 34B, 34C, 34D and chute support member 36 may be configured from the same or similar or different various materials (such as, for example, polypropylene nylon binding tape, nylon blend woven webbing, polypropylene, nylon, nylon blend, cotton, nylon-woven, polyester, elastic, eco-friendly, rubber, jacquard, reflective or the like or other materials). For example, in one or more embodiments, neck member 32 and the at least four support legs 34A, 34B, 34C, 34D may be configured from polypropylene nylon binding tape and chute support member 36 may be configured from nylon blend woven webbing. In one or more embodiments, neck member 32, the at least four support legs 34A, 34B, 34C, 34D and chute support member 36 may be configured from the same or similar or different widths (such as, for example, about ¼ of an inch to about 2 inches wide (e.g. about ¾ of an inch wide)). In one or more embodiments, neck member 32, may be about 1 inch to about 6 inches in length 33 (e.g. about 1 inch in length 33) wherein some portion(s) of neck member 32 may be doubled back on itself or configured to other material or parts of training chute 10 for reinforcement or other purposes (e.g. for enabling configuration to other devices), which doubling back or configurations may reduce neck member's 32 length 33.

In one or more embodiments, the at least four support legs 34A, 34B, 34C, 34D and chute support member 36 may be configured and reinforced to neck member 32 at some location on neck member 32 by various means, materials and methods, such as, in one or more embodiments, by sewing the at least four support legs 34A, 34B, 34C, 34D and chute support member 36 to a bottom portion 38 of neck member 32.

In one or more embodiments, as illustrated in FIG. 5, first member 40 may include a top portion 42 and a bottom portion 44 (although bottom portion 44 is not shown on FIG. 5). In one or more embodiments, first member 40 may be configured from various materials, such as, for example, football mesh, nylon football mesh, woven nylon football mesh, fabric football mesh, polyester mesh (70, 80 or 90 denier), polyester mesh (150 denier), cotton football mesh, cotton-poly football mesh, double knit mesh, air-wick mesh, dazzle mesh, moisture wicking polyester mesh, dazzle cloth polyester, air wicking hybrids or the like or other materials. In one or more embodiments, first member 40 may be provided in virtually an unlimited number of colors.

In one or more embodiments, as illustrated in FIG. 5, second member 50 may include a top portion 52 and a bottom portion 54 (although bottom portion 54 is not shown on FIG. 5). In one or more embodiments, second member 50 may be configured from various materials, such as, for example, 70 denier black nylon rip stop, cotton rip stop, polyester rip stop, woven rip stop, silk rip stop, polypropylene, or the like or other materials, which may include cross-hatched threading. In one or more embodiments, second member 50 may be provided in virtually an unlimited number of colors.

In one or more embodiments, the at least four support legs 34A, 34B, 34C, 34D may be configured to first member 40 at some location on first member 40, such as, in one or more embodiments, top portion 42. In one or more embodiments, the length 37 of each of the at least four support legs 34A, 34B, 34C, 34D may be about 1 inch to about 10 inches (e.g. about 4 inches) from the point at which they may be configured to top portion 42 (which may be points furthest from the outer edge of first member 40) and to the points they are configured to the bottom portion 38 of neck member 32.

In one or more embodiments, reinforcement of training device 10 may be provided. For example, as illustrated in FIG. 5, at least four support members 48A, 48B, 48C, 48D may be provided which may align with and/or be the actual material of the at least four support legs 34A, 34B, 34C, 34D. In one or more embodiments, the at least four support members 48A, 48B, 48C, 48D may be made from the same or similar or different materials as the at least four support legs 34A, 34B, 34C, 34D (such as, for example, polypropylene nylon binding tape, nylon blend woven webbing, polypropylene, nylon, nylon blend, cotton, nylon-woven, polyester, elastic, eco-friendly, rubber, jacquard, reflective or the like or other materials) which may be about ¼ of an inch to about 2 inches wide (e.g. about ¾ of an inch wide). In one or more embodiments, the at least four support members 48A, 48B, 48C, 48D may be sewn to top portion 42 starting near one edge of the first member 40 and continuing until near the opposite edge of the first member 40 and back to the initial edge of first member 40 in any appropriate pattern. In one or more embodiments, the at least four support members 48A, 48B, 48C, 48D may be sewn to the particular at least four support legs 34A, 34B, 34C, 34D to which they are aligned.

In one or more embodiments, as illustrated in FIG. 5, the bottom portion 58 of chute support member 36 may be configured to second member 50 by various means, materials and methods. For example, in one or more embodiments, such may be accomplished by sewing a substantially rectangular or other shaped material 56 to top portion 52 and sewing bottom portion 58 (such as, for example, about 1 inch of bottom portion 58) of chute support member 36 to material 56. In one or more embodiments, material 56 may be configured from various materials (such as, for example, polypropylene nylon binding tape, nylon blend woven webbing, polypropylene, nylon, nylon blend, cotton, nylon-woven, polyester, elastic, eco-friendly, rubber, jacquard, reflective or the like or other materials) which may be about ½ of an inch to about 5 inches in width 51 (e.g. about 1½ inches in width 51) and about ½ an inch to about 5 inches in length 53 (e.g. about 2¾ inches in length 53).

In one or more embodiment, the length 39 of chute support member 36 may be about 4 inches to about 25 inches (e.g. about 16 inches) starting from the point at which it is configured to neck member 32 continuing until the point at which it is configured to top portion 52.

Figure 6A:
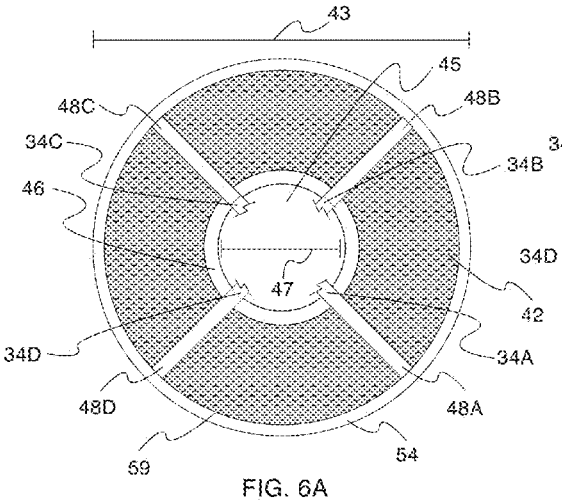
FIG. 6A shows a top view of one embodiment of aspects of a training device, including a first member.

FIG. 6A shows a top view of portions of one embodiment of training device 10. In one or more embodiments, first member 40 may be configured to be about 26 inches to about 34 inches in width 43 (e.g. about 30 inches in width 43), wherein some portion(s) of first member 40 may be doubled back on itself or configured to other material or parts of training chute 10 for reinforcement or other purposes, which may reduce first member's 40 width 43, such as, for example, to about 29 inches in width 43. In one or more embodiments, first member 40 may be configured with an opening, such as, for example, opening 45, which may be located approximately in the center of first member 40 which may be about 4½ inches to about 8½ inches in diameter 47 (e.g. about 6½ inches in diameter 47). In one or more embodiments, reinforcement material 46 may be configured to at least some portion of the edge of the opening, such as, for example, the edge of opening 45. In one or more embodiments, reinforcement material 46 may be configured from various materials (such as, for example, polypropylene nylon binding tape, nylon blend woven webbing, polypropylene, nylon, nylon blend, cotton, nylon-woven, polyester, elastic, eco-friendly, rubber, jacquard, reflective or the like or other materials). In one or more embodiments, metal, plastic, rubber or other material may be configured to reinforcement material 46 so as to stiffen the opening and help ensure that it properly opens during use. FIG. 6A also shows one embodiment of the at least four support members 48A, 48B, 48C, 48D and aspects of the at least four support legs 34A, 34B, 34C, 34D.

Figure 6B:
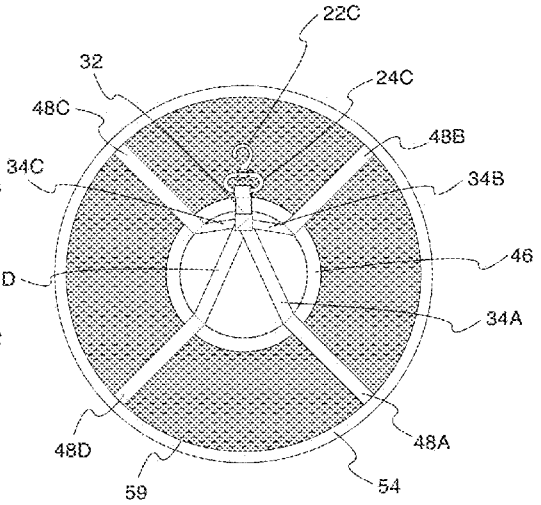
FIG. 6B shows a top view of the embodiment of additional aspects of the training device illustrated in FIG. 6A.

FIG. 6B shows the embodiment of training device 10 illustrated in FIG. 6A excepting that a fuller view of the at least four support legs 34A, 34B, 34C, 34D and attachment unit 20 are also shown.

Figure 7:
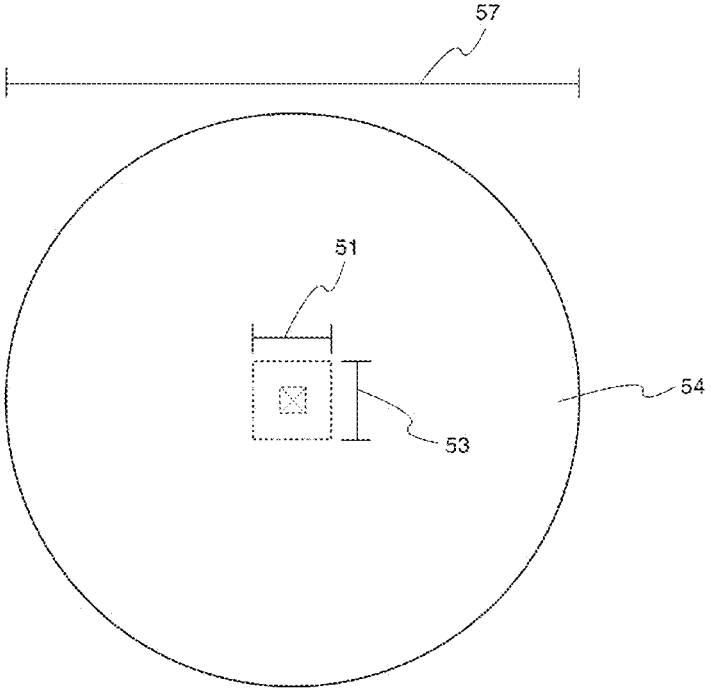
FIG. 7 shows a bottom view of one embodiment of aspects of a training device, including a second member.

FIG. 7 shows a bottom view of one embodiment of aspects of training device 10. In one or more embodiments, second member 50 may be configured to about 25 inches to about 35 inches in width 57 (e.g. about 31 inches in width 57), wherein some portion(s) of second member 50 may be doubled back on itself or configured to other material or parts of training chute 10 for reinforcement or other purposes, which may reduce second member's width 57, such as, for example, to about 30 inches in width 57. FIG. 7 shows one embodiment of sewing on the bottom portion 54 of second member 50 that may be associated with the substantially rectangular piece of material 56 which may be sewn to top portion 52 and the sewing associated with the bottom portion 58 of chute support member 36 may be sewn to material 56.

Figure 8A:
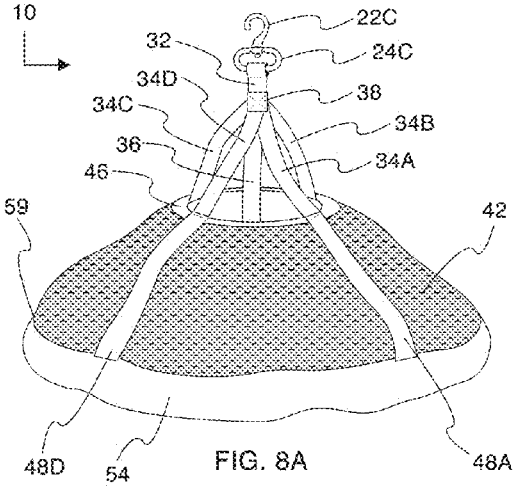
FIG. 8A shows a perspective view of one embodiment of aspects of a training device, including where a first member may be configured to a second member.

FIG. 8A is a perspective view of one embodiment of training device 10 wherein first member 40 is configured to second member 50 and wherein aspects of training device 10 is slightly raised. In one or more embodiments, first member 40 may be configured to second member 50 by various means, materials and methods, such as, for example, by sewing them together along or near the circumferences or edges of their respective exterior edges, such as, for example, at a location 59 where first member 40 and second member 50 may be configured together.

Figure 8B:
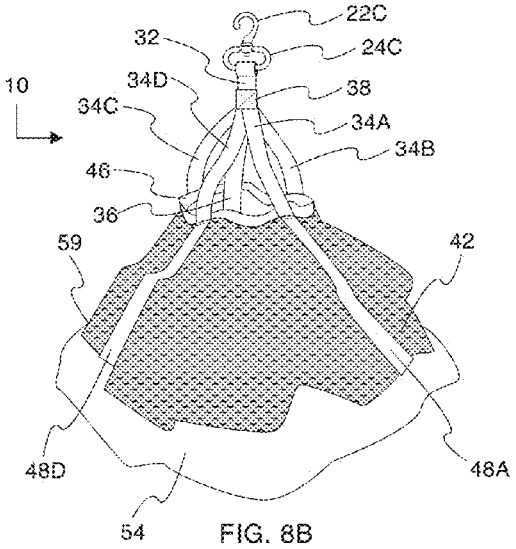
FIG. 8B shows a perspective view of the embodiment of aspects of the training device illustrated in FIG. 8A, with aspects of the training device being elongated.

FIG. 8B is a perspective view of the embodiment of training device 10 as illustrated in FIG. 8A, however, the training device 10 as shown in FIG. 8B has been elongated. At least one purpose of the view in FIG. 8B is to show that at least some of the material from which training device 10 may be configured may be flexible and malleable, making it easily storable, transportable and adaptable.

Although the embodiments illustrated in FIGS. 1 through 8B shows certain aspects of training device 10 in a substantially circular configuration, in one or more embodiments, it may be configured to various shapes, such as, for example, substantially oval, square, rectangle, diamond, octagon, hexagon, decagon, nonagon, rounded or substantially some other shape or combinations of shapes. In one or more embodiments, aspects of training device 10 may be configured to a theoretically unlimited number of colors and/or combinations of colors, such as for example, first member 40 may be jet black and second member 50 may be black, blue, red, orange, green, pink, white, and/or gray.

Figure 9:
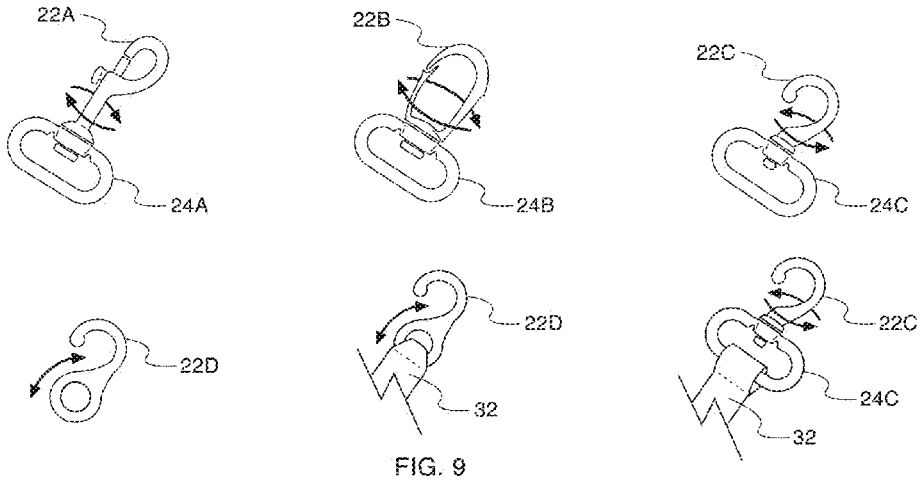
FIG. 9 shows various embodiments of hook members.

FIG. 9 shows a number of embodiments of hook members which may be included in attachment unit 20. For example, hook member 22A is a bolt snap hook with a swivel 24A, hook member 22B is a push gate snap hook with a swivel 24B, hook member 22C is a basic hook with a swivel 24C, and hook member 22D is a non-swivel basic hook. The embodiments of hook members illustrated in FIG. 9 are just a few possible types of hook members that may be used with training device 10. There are numerous types, sizes and other configurations of hook members and parts of hook members that may be used and/or interchangeably used with training device 10. For example, a hook member may include one or more spring hooks, non-swivel hooks, swivel hooks, swivel head connectors, swivel rings, ring snap hook, bolt snaps, double end bolt snaps, trigger snaps, marine hooks, push gate hooks, lobster hooks, u-sleeve hooks, wire gate hooks, clips, s-clips, d-rings, rings, carabiners, etc. The number, type, size and other configurations of the hook members and parts of hook members that may be used may vary depending on various reasons or combinations of reasons, such as, for example: (i) what configuration of the hook member(s) may be compatible to the configuration of other portions of training device 10 and/or the configuration of apparatuses other than training device 10, or (ii) the results a user desires to achieve when using training device 10.

In one or more embodiments, numerous devices may be configured to training device 10 in various ways, by various means, materials and methods, for various reasons. For example, in one or more embodiments, various hand units, strap units and other devices may be configured to training device 10 (such as, for example, loops, hooks, sleeves or retention or retaining devices or devices which provide other functionalities). In one or more embodiments, devices may include various sporting equipment and devices.

FIGS. 10A through 11D show various views of various embodiments of strap units that may be used in conjunction with training device 10. There are numerous types, sizes and other configurations a strap unit (including its parts) may have. Different strap units may be used and/or interchangeably used with training device 10. The type, size and other configurations of a strap unit that may be used may vary depending on various reasons or combinations of reasons, such as, for example: (i) the type, size and other configurations of a strap unit may be modified in order to make it compatible with portions of training device 10 and/or apparatuses other than training device 10, or (ii) the type, size and other configurations of a strap unit may be modified in order to achieve or increase the likelihood of achieving the results a user desires to achieve when using training device 10.

In one or more embodiments, a strap unit may be used in conjunction with a variety of devices and/or combinations of devices (generically referred to in FIGS. 13, 16, and 18 as "first device") and activities. For example, in one or more embodiments, a strap unit may be used in conjunction with and/or to promote the use of devices and/or sporting or other activities which may include the use of a handle, club, shaft, rod or stick-like element, such as, for example, golf clubs, tennis rackets, bats (such as, for example, illustrated in FIGS. 19A, 19B and 19C), hockey sticks (such as, for example, illustrated in FIGS. 20A and 20B), sword fighting, axe-throwing, axing, pickle ball, racquetball, badminton, cricket, lacrosse, polo, table tennis, squash, and the like and other activities. In another example, in one or more embodiments, a strap unit may be used in conjunction with and/or to promote the use of devices and/or sporting or other activities which may include a swinging, kicking, hitting, stroking, throwing (such as, for example, illustrated in FIGS. 17D and 17E) or other motion(s), such as, for example, baseball, softball, football, rugby, handball, wallyball, dodgeball, volleyball, Frisbee, disc golf discs, soccer, kickball, javelin, discus, shotput, boxing, kickboxing, martial arts, swimming, and bowling, and the like and other activities. In another example, in one or more embodiments, a strap unit may be used in conjunction with human and/or artificial appendages, such as, for example, a user's fingers, hands, legs, arms, etc.

Figure 10A:
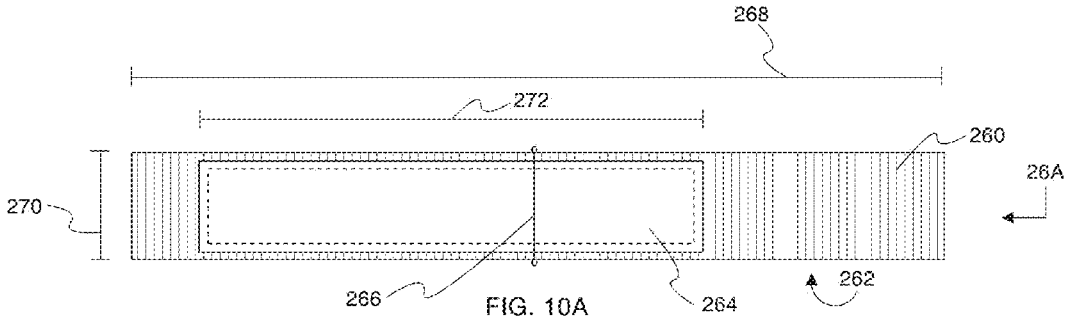
FIG. 10A shows a bottom view of one embodiment of a strap unit.

FIG. 10A shows a bottom view of one embodiment of strap unit 26A. In one or more embodiments, strap unit 26A may include a bottom surface 260, a top surface 262 (although not shown in FIG. 10A) and a means 264 for gripping devices. In one or more embodiments, strap unit 26A may be configured to various dimensions, from various materials, with various parts, for various reasons (such as, for example, polypropylene nylon binding tape, nylon blend woven webbing, polypropylene, nylon, nylon blend, cotton, nylon-woven, polyester, elastic, eco-friendly, rubber, jacquard, reflective or the like or other materials).

For example, in one or more embodiments, bottom surface 260 may be configured with a loop type mechanism (such as, for example, felt or Velcro, including nylon Velcro, poly-plastic Velcro, poly-propylene Velcro, etc., including, single or double sided Velcro, or the like or other material) and top surface 262 may be configured with a hook type mechanism (such as, for example, felt or Velcro, including nylon Velcro, poly-plastic Velcro, poly-propylene Velcro, etc., including, single or double sided Velcro, or the like or other material) so that bottom surface 260 and top surface 262 may hook and loop together (such as, for example, conventional Velcro or felt-hook or other combinations). In another embodiment, bottom surface 260 may be configured with a hook type mechanism (such as, for example, as described above) and top surface 262 may be configured with a loop type mechanism (such as, for example, as described above) so that bottom surface 260 and top surface 262 may hook and loop together (such as, for example, conventional Velcro or felt-hook or other combinations). In one or more embodiments, means 264 for gripping devices may be configured with tactified rubber material which may be sewn onto bottom surface 260 of strap unit 26A.

In one or more embodiments, strap unit 26A may have a length 268 of about 10½ inches to about 16½ inches (e.g. about 13½ inches) and a width 270 of about ½ of an inch to about 4 inches (e.g. about 1½ inches). In one or more embodiments, means 264 for gripping devices may have a length 272 of about 5 inches to about 12 inches (e.g. about 8 inches). In one or more embodiments, a seam 266 may be sewn into strap unit 26A. In one or more embodiments, various portions of means 264 may be on one side of seam 266 (e.g. about 3 inches) and the remaining portion of means 264 (e.g. about 5 inches) may be on the other side of seam 266.

Figure 10B:
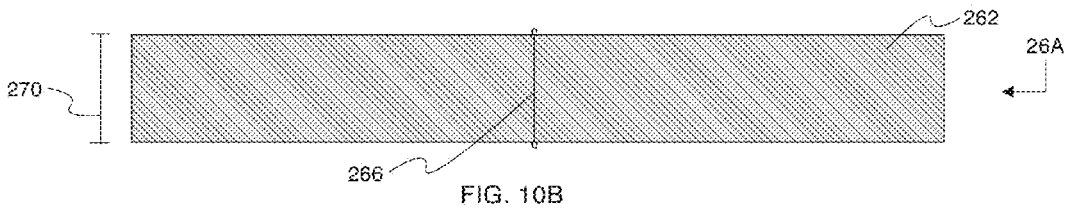
FIG. 10B shows a top view of one embodiment of the strap unit illustrated in FIG. 10A.

FIG. 10B shows a top view of one embodiment of strap unit 26A. In one or more embodiments, the material from which top surface 262 may be configured (such as, for example, a hook or loop type mechanism such as, for example, felt or Velcro or the like or other material) may comprise some or all of length 268 of top surface 262.

Figure 10C:
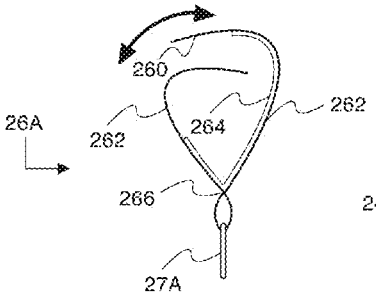
FIG. 10C shows a side view of one embodiment of a strap unit, including aspects of its configuration.

FIG. 10C shows a side view of one embodiment of strap unit 26A. In one or more embodiments, bottom surface 260 may be configured to be releasably attachable to top surface 262 (such as, for example, is typical of conventional Velcro or felt-hook or other combinations or the like or other materials). For example, in one or more embodiments, strap unit 26A may be configured to be capable of being opened for inserting a device or appendage into a loop, closed around the device or appendage, and re-opened for removal of the device or appendage. In one or more embodiments, strap unit 26A may include a means for configuring strap unit 26A to training device 10. For example, in one or more embodiments, said means may include a ring, such as, for example, d-ring (see FIGS. 10D and 10E for one or more embodiments). The means for configuring strap unit 26A to training device 10 may be configured anywhere on strap unit 26A, such as, for example, near seam 266 which may be about the midpoint of strap unit 26A.

Figure 10D:
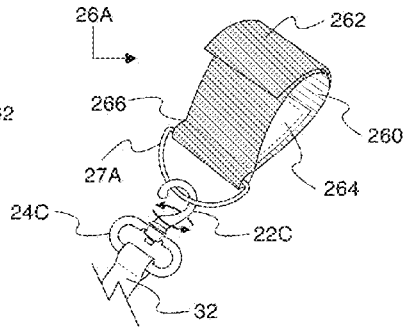
FIG. 10D shows a perspective view of one embodiment of a strap unit, including aspects of its configuration and one embodiment of a means for configuring the strap unit to training device.

FIG. 10D shows a perspective view of one embodiment of strap unit 26A and a means for configuring strap unit 26A to training device 10. Said means may include various means, methods and materials, such as, for example, a d-ring 27A configured to strap unit 26A which d-ring 27A may be configured to hook member 22C (which may be configured with swivel 24C) which may be configured to neck member 32.

Figure 10E:
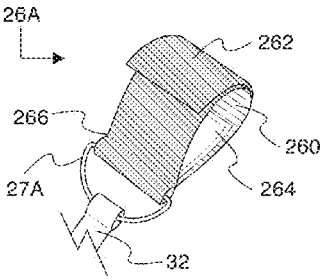
FIG. 10E shows a perspective view of one embodiment of a strap unit, including aspects of its configuration and another embodiment of a means for configuring the strap unit to training device.

FIG. 10E shows a perspective view of one embodiment of strap unit 26A and an embodiment of a means for configuring strap unit 26A to training device 10. Said means for configuring strap unit 26A to training device 10 may include a d-ring 27A configured to strap unit 26A which d-ring 27A may be configured to neck member 32 without a hook member.

Figure 11A:
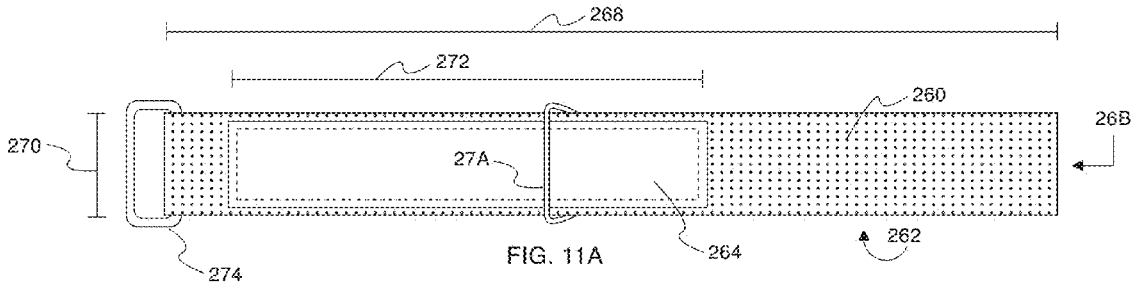
FIG. 11A shows a bottom view of another embodiment of a strap unit.

FIG. 11A shows a bottom view of an alternative and/or additional embodiment of a strap unit—strap unit 26B. In one or more embodiments, strap unit 26B may include a bottom surface 260, a top surface 262 (although not shown in FIG. 11A), a means 264 for gripping devices, and a means 274 for synching strap unit 26B to the device. In one or more embodiments, strap unit 26B may be configured to various dimensions, from various materials, with various parts, for various reasons (such as, for example, polypropylene nylon binding tape, nylon blend woven webbing, polypropylene, nylon, nylon blend, cotton, nylon-woven, polyester, elastic, eco-friendly, rubber, jacquard, reflective or the like or other materials). For example, in one or more embodiments, means 264 for gripping devices may be configured with tactified rubber material which may be sewn onto bottom surface 260 of strap unit 26B.

In one or more embodiments, strap unit 26B may have a length 268 of about 13½ inches to about 19½ inches (e.g. about 16½ inches) and a width 270 of about ½ an inch to about 4 inches (e.g. about 1½ inches). In one or more embodiments, means 264 for gripping devices may have a length 272 of about 5 inches to about 12 inches (e.g. about 8 inches).

In one or more embodiments, means 274 for synching strap unit 26B to the device or appendages may include and be accomplished by various devices (such as, for example, buckles, hooks, rings, clasps, chains, snaps, clips, etc.) working in conjunction with various materials (such as, for example, felt or Velcro or the like or other materials). For example, in one or more embodiments, means 274 may include rounded rectangular ring that may be configured to one end of strap unit 26B and able to receive and allow the other end of strap unit 26B to pass through and around the ring and be attached, secured, or otherwise configured back on itself (see FIG. 11C).

In one or more embodiments, strap unit 26B may include a means for configuring strap unit 26B to training device 10. For example, in one or more embodiments, said means may include a ring, such as, for example, d-ring 27A (see FIGS. 11A through 11D). The means for configuring strap unit 26B to training device 10 may be configured anywhere on strap unit 26B.

Figure 11B:
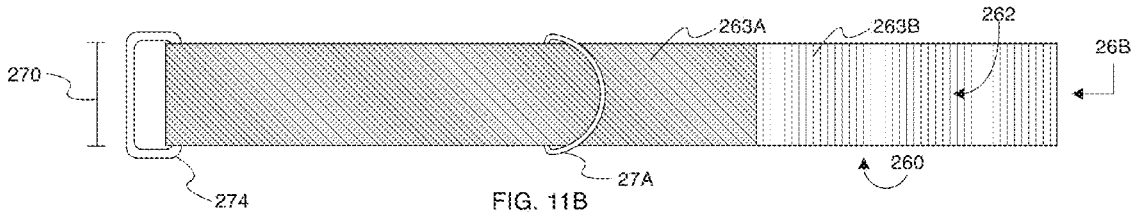
FIG. 11B shows a top view of one embodiment of the strap unit illustrated in FIG. 11A.

FIG. 11B shows a top view of one embodiment of strap unit 26B. In one or more embodiments, some portion 263A of top surface 262 may be configured differently and/or with different material as compared to another portion 263B of top surface 262 so that, unlike strap unit 26A, top surface 262 of strap unit 28B may be placed through means 274 and adhered, connected, secured, attached or otherwise configured back on its self. For example, in one or more embodiments, some portion 263A of top surface 262 may be configured with a hook type mechanism (such as, for example, felt or Velcro, including nylon Velcro, poly-plastic Velcro, poly-propylene Velcro, etc., including, single or double sided Velcro, or the like or other material) and another portion 263B of top surface 262 may be configured with a loop type mechanism (such as, for example, Velcro or felt or the like or other material, as the case may be), or vice versa, so that some portion 263A of top surface 262 and the other portion 263B of top surface 262 may hook and loop together (such as, for example, conventional Velcro or felt-hook or other combinations).

Figure 11C:
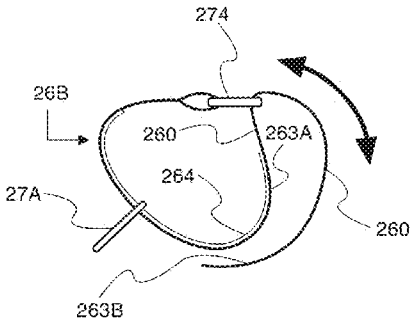
FIG. 11C shows a side view of one embodiment of a strap unit, including aspects of its configuration.

FIG. 11C shows a side view of one embodiment of strap unit 26B. In one or more embodiments, some portion 263A of top surface 262 may be configured to be releaseably attachable onto another portion 263B of top surface 262. For example, in one or more embodiments, strap unit 26B may be configured to be capable of being opened for inserting device or appendages into a loop, closed around the device or appendage, synched, and re-opened for removal of the device or appendage.

Figure 11D:
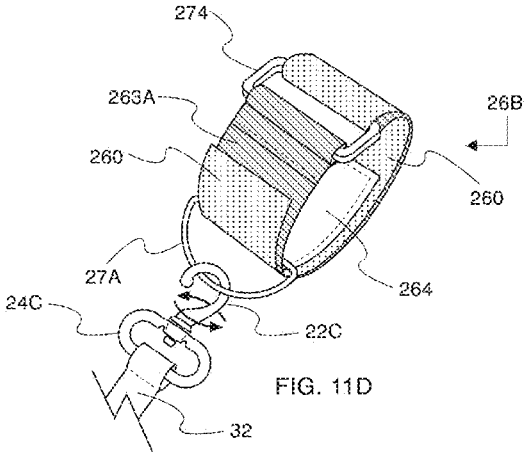
FIG. 11D shows a perspective view of one embodiment of a strap unit, including aspects of its configuration and one embodiment of a means for configuring the strap unit to training device.

FIG. 11D shows a perspective view of one embodiment of a means for configuring strap unit 26B to training device 10. Said means may include various means, methods and materials, such as, for example, a d-ring 27A configured to strap unit 26B which d-ring 27A may be configured to hook member 22C (which may be configured with swivel 24C) which may be configured to neck member 32. Although not shown in FIG. 11D, in one or more embodiments, said means for configuring strap unit 26B to training device 10 may include a d-ring 27A configured to strap unit 26B which d-ring 27A may be configured to neck member 32 without a hook member.

Figure 12A:
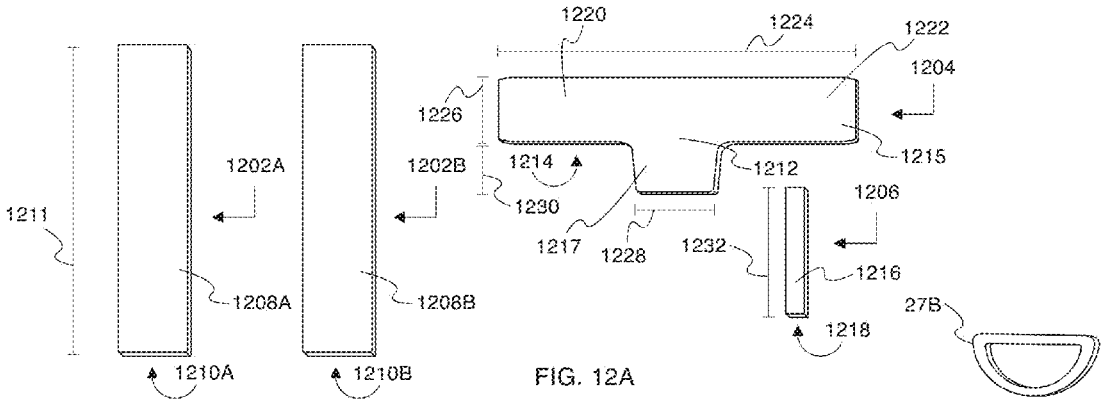
FIG. 12A shows one embodiment of various aspects of a hand unit, which may include at least two strap members, a handle member, a reinforcement member, and a means for configuring the hand unit to a training device.
Figure 12B:
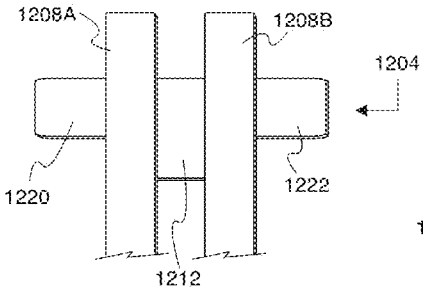
FIG. 12B shows a bottom view of one embodiment of aspects of the configuration of a hand unit, including at least two strap members and a handle member.
Figure 12C:
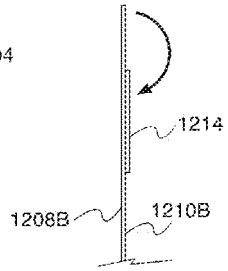
FIG. 12C shows a side view of one embodiment of aspects of the configuration of a hand unit.
Figure 12D:
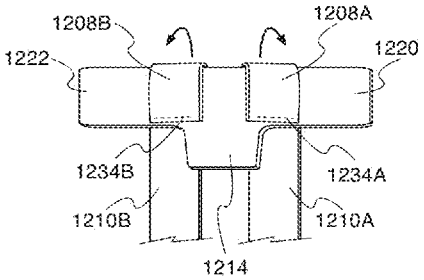
FIG. 12D shows a top view of one embodiment of aspects of the configuration of a hand unit, including configuring at least two strap members to a handle member.
Figure 12E:
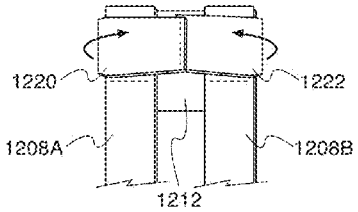
FIG. 12E shows a bottom view of one embodiment of aspects of the configuration of a hand unit, including the configuration of aspects of a handle member.
Figure 12F:
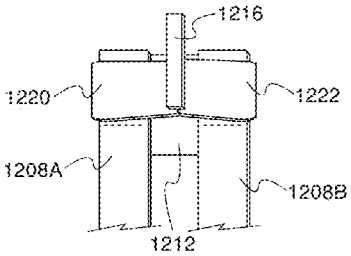
FIG. 12F shows the bottom view of the embodiment illustrated in FIG. 12E, albeit with a reinforcement member presented.
Figure 12G:
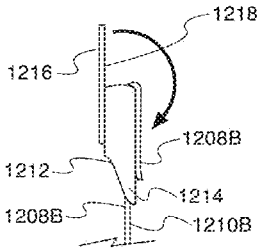
FIG. 12G shows a side view of one embodiment of aspects of the configuration of a hand unit, including configuring a reinforcement member to the hand unit.
Figure 12H:
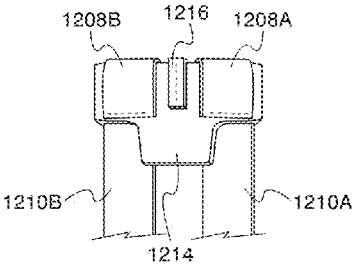
FIG. 12H shows a top view of one embodiment of aspects of the configuration of a hand unit.
Figure 12I:
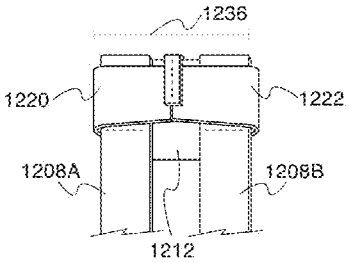
FIG. 12I shows a bottom view of one embodiment of aspects of the configuration of a hand unit.
Figure 12J:
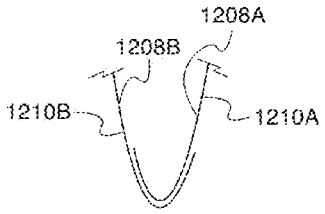
FIG. 12J shows a side view of one embodiment of aspects of the configuration of a hand unit, including the configuration of the at least two strap members.
Figure 12K:
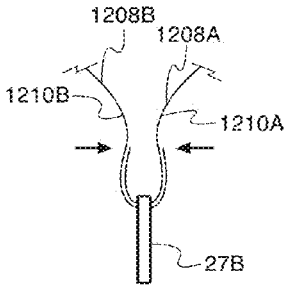
FIG. 12K shows a side view of one embodiment of aspects of the configuration of a hand unit, including presenting a d-ring.
Figure 12L:
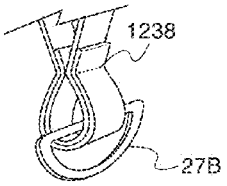
FIG. 12L shows a perspective view of one embodiment of aspects of the configuration of a hand unit, including configuring the at least two straps together.
Figure 12M:
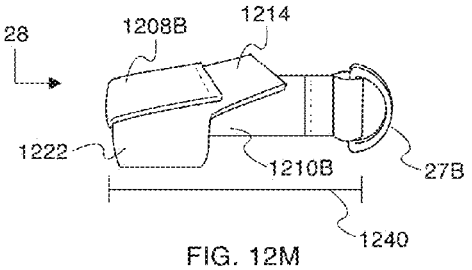
FIG. 12M shows a side view of one embodiment of a hand unit.
Figure 12N:
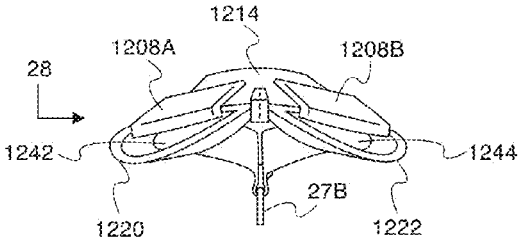
FIG. 12N shows a front view of one embodiment of a hand unit.
Figure 120:
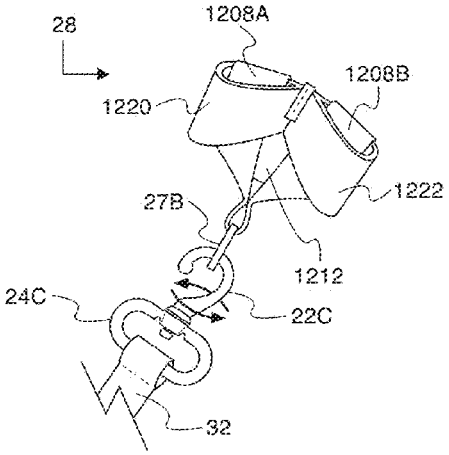
Figure 12P:
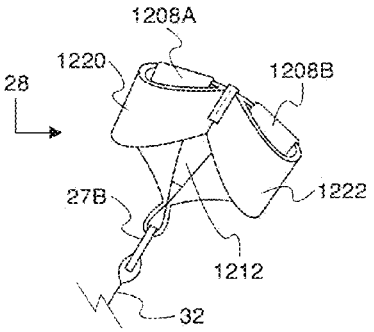
FIG. 12P shows a bottom view of one embodiment of a hand unit, including another embodiment of a means for configuring the hand unit to a training device.

FIGS. 12A through 12P show various views of one or more embodiments of a hand unit 28 that may be configured to training device 10. In one or more embodiments, hand unit 28 may be used in conjunction with variety of devices and/or combinations of devices (generically referred to in FIGS. 13, 16, and 18 as "first device") and activities. For example, in one or more embodiments, a strap unit may be used in conjunction with and/or to promote the use of devices and/or sporting or other activities which may include a swinging, kicking, hitting, stroking, throwing (see FIG. 17C) or other motion(s), such as, for example, baseball (see FIG. 17D), softball, football (see FIG. 17E), rugby, handball, wallyball, dodgeball, volleyball, Frisbee, disc golf discs, soccer, kickball, javelin, discus, shotput, boxing, kickboxing, martial arts, swimming, and bowling, and the like and other activities. In another example, in one or more embodiments, a strap unit may be used in conjunction with human and/or artificial appendages, such as, for example, a user's fingers (see FIGS. 17A through 17E), etc.

FIG. 12A shows one embodiment of various aspects of hand unit 28, which may include, at least two strap members 1202A, 1202B, a handle member 1204, a reinforcement member 1206, and a means for configuring hand unit 28 to training device 10. The at least two strap members 1202A, 1202B, handle member 1204, reinforcement member 1206, and means for configuring hand unit 28 to training device 10 may be configured to various dimensions, from various materials, with various parts, for various reasons.

In one or more embodiment, strap members 1202A may include a bottom surface 1208A and a top surface 1210A (although not shown in FIG. 12A) and strap member 1202B may include a bottom surface 1208B and a top surface 1210B (although not shown in FIG. 12A). In one or more embodiment, the at least two strap members 1202A, 1202B may each be configured from various materials (such as, for example, polypropylene nylon binding tape, nylon blend woven webbing, polypropylene, nylon, nylon blend, cotton, nylon-woven, polyester, elastic, eco-friendly, rubber, jacquard, reflective or the like or other materials) which may each be about ¼ of an inch to about 2 inches wide (e.g. about ¾ of an inch wide) and about 1 inch to about 12 inches in length 1211 (e.g. about 6 inches in length 1211).

In one or more embodiment, handle member 1204 may include a bottom surface 1212, a top surface 1214 (although not shown in FIG. 12A), an upper portion 1215, a lower portion 1217, and at least two wing members 1220, 1222. In one or more embodiment, handle member 1204 may be configured to various dimensions, from various materials, with various parts, for various reasons (such as, for example, neoprene, ⅛ inch thick rubber coated thick neoprene, silicone rubber sheet, silicone sponge rubber sheet, stretch jersey neoprene, neoprene foam cell, neoprene sheet, 60 durometer, neoprene-polychloroplene, or the like and other materials).

In one or more embodiment, the upper portion 1215 of handle member 1204 may be configured to be about ⅛ of an inch to about 10 inches in width 1224 (e.g. about 6½ inches in width 1224) and about ⅛ of an inch to about 10 inches in length 1226 (e.g. about 1½ inches in length 1226). In one or more embodiment, the lower portion 1217 of handle member 1204 may be configured to be about ⅛ of an inch to about 10 inches in width 1228 (e.g. about 3½ inches in width 1228) and about ⅛ of an inch to about 10 inches in length 1230 (e.g. about 1½ inch in length 1230). In one or more embodiment, the center of lower portion 1217 may be configured to be positioned at about the center of upper portion 1215.

In one or more embodiment, reinforcement member 1206 may include a top surface 1216 and a bottom surface 1218 (although not shown in FIG. 12A). In one or more embodiment, reinforcement member 1206 may be configured to various dimensions, from various materials, with various parts, for various reasons (such as, for example, polypropylene nylon binding tape, nylon blend woven webbing, polypropylene, nylon, nylon blend, cotton, nylon-woven, polyester, elastic, eco-friendly, rubber, jacquard, reflective or the like or other materials) which may be about ⅛ of an inch to about 2 inches wide (e.g. about ⅜ of an inch wide) and about ½ of an inch to about 18 inches in length 1232 (e.g. about 2 inches in length 1232).

In one or more embodiment, a means for configuring hand unit 28 to training device 10 may be accomplished in a variety of ways, by a variety of means, methods and materials. For example, in one or more embodiments, the following may be utilized for providing for the configuration of hand unit 28 to training device 10: d-rings (such as, for example, d-ring 27B), or hook members (such as, for example, those described herein), or providing a loop in the material (such as, for example, configuring the at least two strap members 1202A, 1202B in a loop configuration) so as to create an opening through which a hook member or other device may be configured. There are numerous configurations and devices that may be used and/or interchangeably used as a means for configuring hand unit 28 to training device 10.

FIGS. 12B through 12L show embodiments of aspects of and/or steps which may be used to configure hand unit 28. Although not shown, the configuration of hand unit 28 may be accomplished in a variety of ways, by a variety of means, methods and materials.

FIG. 12B shows a bottom view of one embodiment of aspects of configuring the at least two strap members 1202A, 1202B to handle member 1204 wherein strap member 1202A and strap member 1202B may be positioned approximately parallel to each other and about ¼ of an inch to about 5 inches apart (e.g. about 1¼ of an inch apart) and positioned approximately perpendicularly across the bottom surface 1212 of handle member 1204 as illustrated in FIG. 12B.

FIG. 12C shows a side view of one embodiment of aspects of configuring the at least two strap members 1202A, 1202B to handle member 1204 wherein portions of strap member 1202A (although not shown in FIG. 12C) and strap member 1202B may be folded over bottom surface 1212 of handle member 1204 and configured to top surface 1214 of handle member 1204.

FIG. 12D shows a top view of one embodiment of aspects of configuring the at least two strap members 1202A, 1202B to handle member 1204 wherein the at least strap members 1202A, 1202B may be sewn to handle member 1204 at various locations on strap members 1202A, 1202B and handle member 1204, such as, for example, at locations 1234A, 1234B, which sewing may pass through bottom surfaces 1208A, 1208B and top surfaces 1210A, 1210B of the at least two strap members 1202A, 1202B, through top surface 1214 and bottom surface 1212 of handle member 1204, and through top surfaces 1210A, 1210B and bottom surfaces 1208A, 1208B of the at least two strap members 1202A, 1202B (see also FIG. 12E), so that the at least two strap members 1202A, 1202B and handle member 1204 may be configured together.

FIG. 12E shows a bottom view of one embodiment of aspects of configuring the at least two strap members 1202A, 1202B to handle member 1204 wherein wing member 1220 and wing member 1222 may be folded over bottom surfaces 1208A, 1208B of the at least two strap members 1202A, 1202B so that wing member 1220 and wing member 1222 may or may not overlap each other and may be configured to bottom surface 1212 of handle member 1204.

FIG. 12F shows one embodiment of aspects of configuring reinforcement member 1206 to handle member 1204 wherein the bottom surface 1218 of reinforcement member 1206 may be positioned approximately perpendicularly over wing member 1220 and wing member 1222.

FIG. 12G shows a side view of one embodiment of aspects of configuring reinforcement member 1206 to handle member 1204 wherein reinforcement member 1206 may be folded over and configured to wing member 1220, wing member 1222, bottom surface 1212 and top surface 1214 of handle member 1204 at a location which may be in between the at least two strap members 1202A, 1202B so as to create two openings through which a user may insert his or her fingers (see also FIGS. 12N, 12O, 12P and 17A).

FIGS. 12H and 12I shows embodiments of aspects of configuring reinforcement member 1206 to handle member 1204 wherein reinforcement member 1206 may be sewn to top surface 1214, wing member 1222, wing member 1220, and bottom surface 1212 of handle member 1204, which sewing may pass through top surface 1216 and bottom surface 1218 of reinforcement member 1206, through top surface 1214 and bottom surface 1212 of handle member 1204, through wing members 1222, 1220, and through bottom surface 1218 and top surface 1216 of reinforcement member 1206. In one or more embodiments, hand unit 28 may have a width 1236 of about 1½ inches to about 10 inches (e.g. about 3½ inches).

FIGS. 12J, 12K, and 12L show embodiments of aspects of steps which may be taken to provide a means for configuring hand unit 28 to training device 10. In one or more embodiment, a means for configuring hand unit to training device 10 may be accomplished in a variety of ways, by a variety of means, methods and materials.

FIG. 12J shows a side view of one embodiment of aspects of configuring hand unit 28 with a means for configuring hand unit 28 to training device 10, wherein about ⅛ of an inch to about 8 inches (e.g. about 2 inches) of top surface 1210A of strap member 1202A may be aligned with and/or cover about ⅛ of an inch to about 8 inches (e.g. about 2 inches) of bottom surface 1208B of strap member 1202B.

FIG. 12K shows a side view of one embodiment of aspects of configuring hand unit 28 with a means for configuring hand unit 28 to training device 10, wherein a means for configuring hand unit to training device 10 may be positioned and/or surround the aligned strap members 1202A, 1202B, such as, for example, sliding a d-ring 27B over the aligned at least two strap members 1202A, 1202B. In one or more embodiments, the at least two straps 1202A, 1202B may then be folded towards each other and positioned and made ready to be configured together.

FIG. 12L shows a perspective view of one embodiment of aspects of configuring hand unit 28 with a means for configuring hand unit 28 to training device 10, wherein d-ring 27B (or other means if implemented) may be releasably or non-releasably enclosed to prevent removal, such as, for example, by configuring (such as, for example, sewing) the at least two strap members 1202A, 1202B together at a location (such as, for example, location 1238) above d-ring 27B (or other means if implemented) to form a loop wherein d-ring 27B (or other means if implemented) may be positioned.

FIG. 12M is a side view of one embodiment of hand unit 28. In one or more embodiments the length 1240 of hand unit 28 may be about 1½ inches to about 12 inches (e.g. about 5 inches).

FIG. 12N shows a front view of one embodiment of hand unit 28. In one or more embodiments, a user may insert his or her finger(s) through opening 1242 and/or opening 1244 when using hand unit 28.

FIG. 12O shows one embodiment of means for configuring hand unit to training device 10 which may be accomplished by use of hook member 22C (which may include swivel 24C) that may be configured to neck member 32 on one end and to d-ring 27B on the other.

FIG. 12P shows one embodiment of means for configuring hand unit to training device 10 which may be accomplished by configuring neck member 32 to d-ring 27B.

Figure 13:
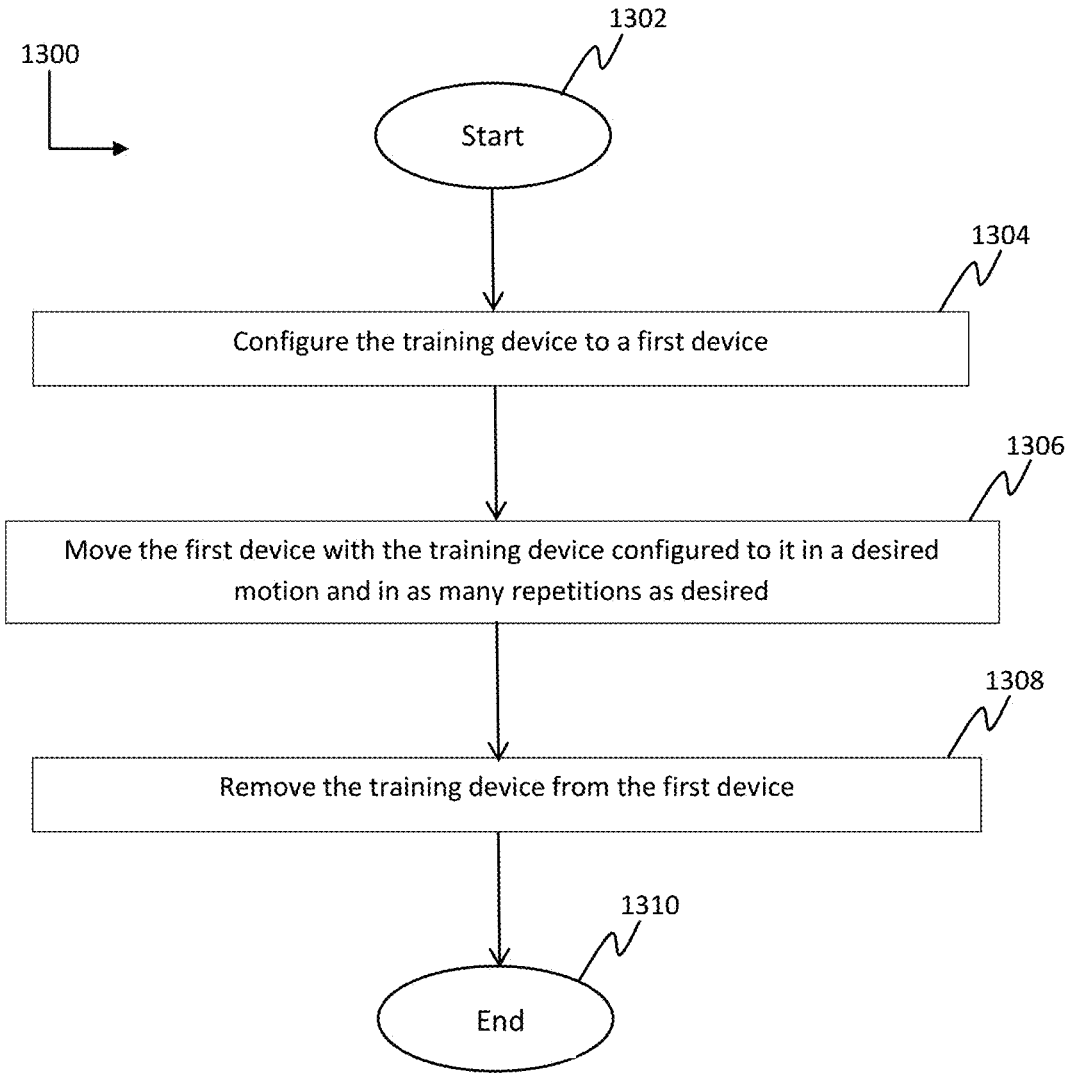
FIG. 13 shows a flow diagram that depicts one embodiment of a method for using a training device.
Figure 16:
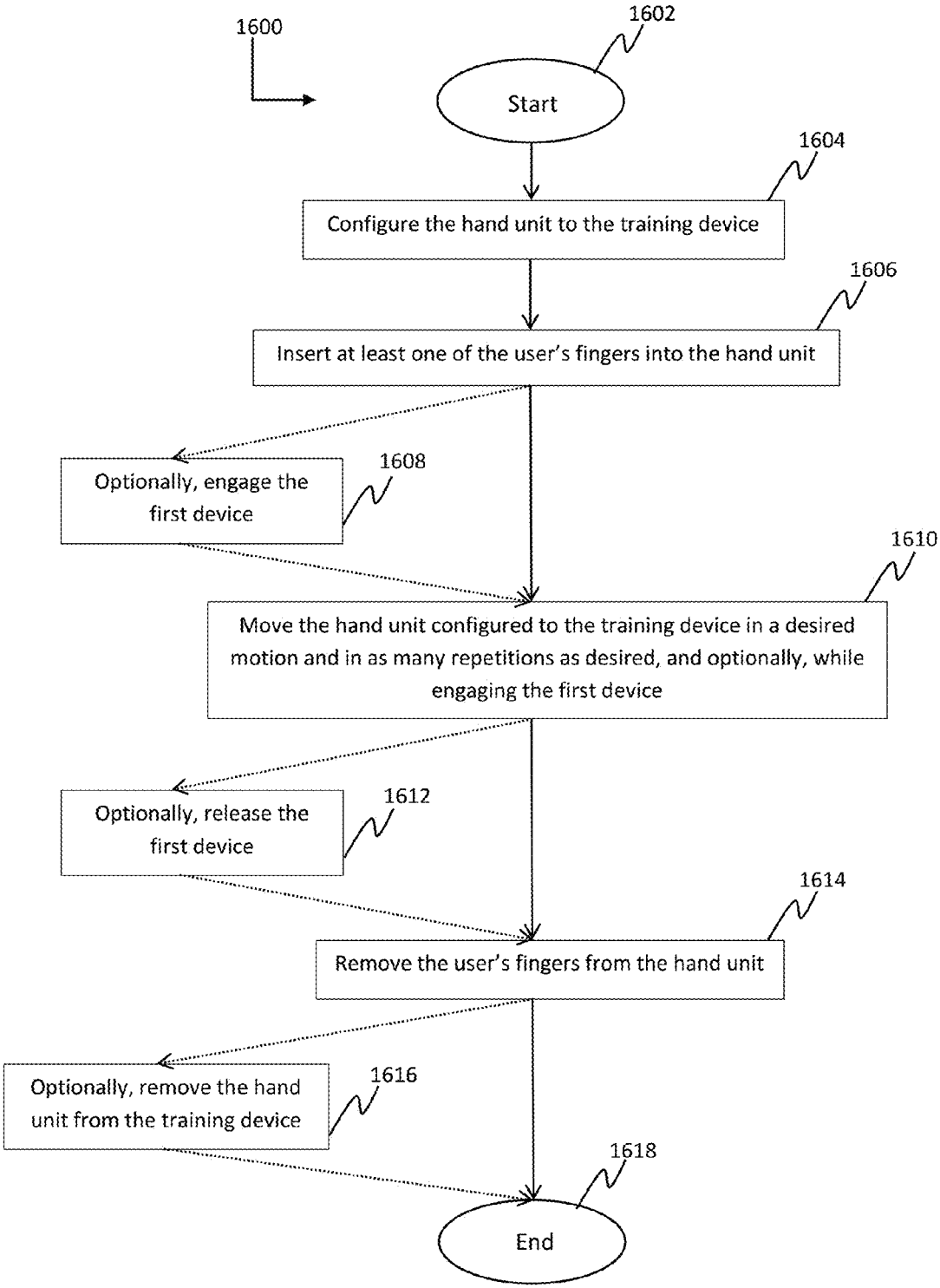
FIG. 16 shows a flow diagram that depicts one embodiment of one method for using a training device with a hand unit.
Figure 18:
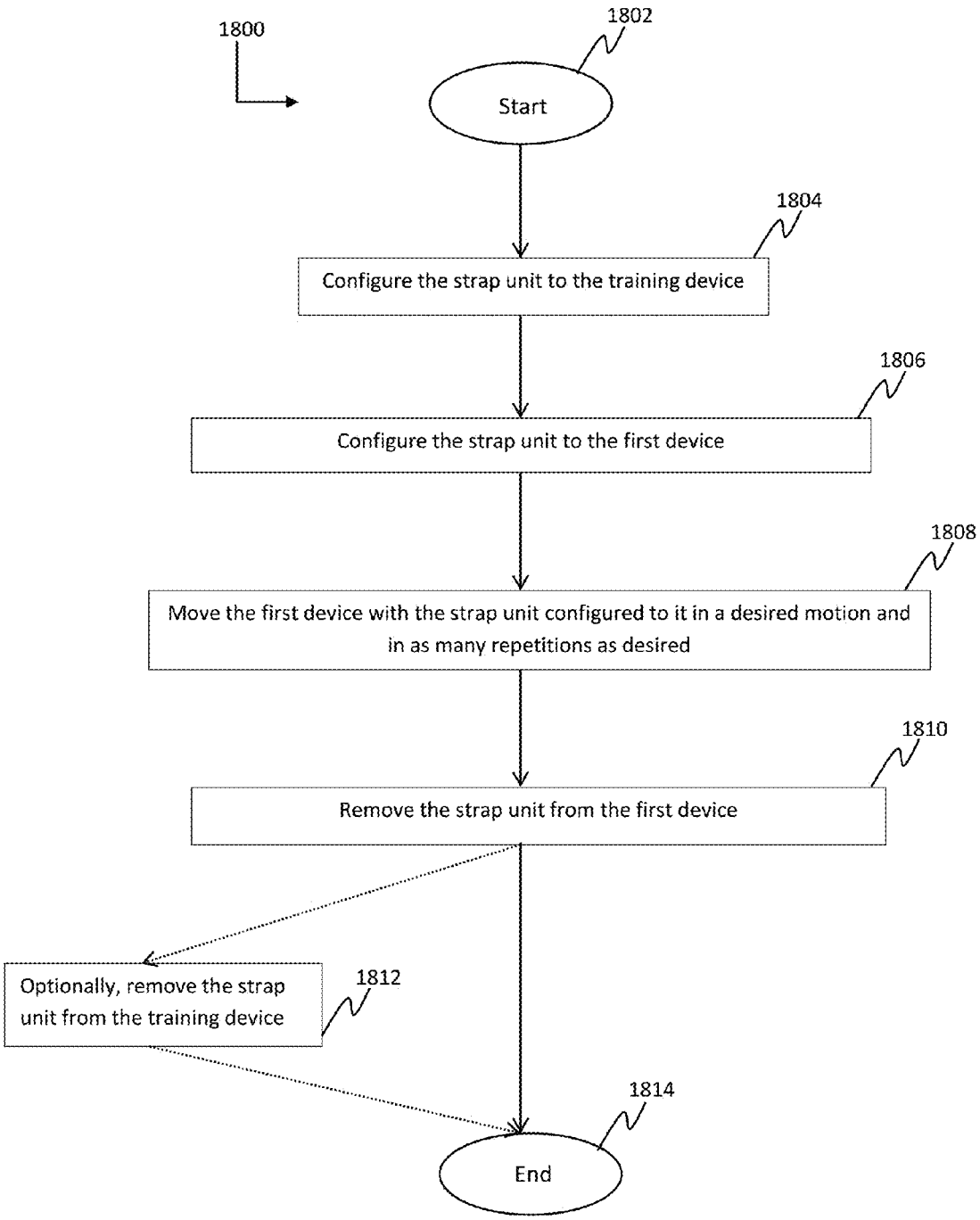
FIG. 18 shows a flow diagram that depicts one embodiment of one method for using a training device with a strap unit.

In one or more embodiments, a user may use training device 10 for various reasons, to perform various functions, and in various ways. For example, FIGS. 13, 16 and 18 are flow diagrams that depict embodiments of methods for using training device 10. In one or more embodiments, methods for using training device 10, such as, for example, methods 1300, 1600 and 1800, as respectively illustrated in flow diagram FIGS. 13, 16 and 18, may be customized, flexible and adapted to various circumstances and situations and may be used by various users. The term "user" denotes any person which uses, in any way, all or part of a method for using training device 10 (and any device configured to or associated with training device 10) and/or all or part of a system which implements such a method, such as, for example, methods 1300, 1600 and 1800 as respectively illustrated in flow diagram FIGS. 13, 16 and 18.

FIG. 13 is a flow diagram that depicts one embodiment of a method 1300 for using training device 10. FIGS. 14A, 14B, 15A and 15B depict embodiments of aspects of implementing method 1300. The appearance, features, types, and configurations of the devices that may be used in conjunction with training device 10 are not limited to those illustrated in FIG. 14A, 14B, 15A or 15B but may vary greatly while still remaining true to the spirit and principles of this disclosure.

Figure 14A:
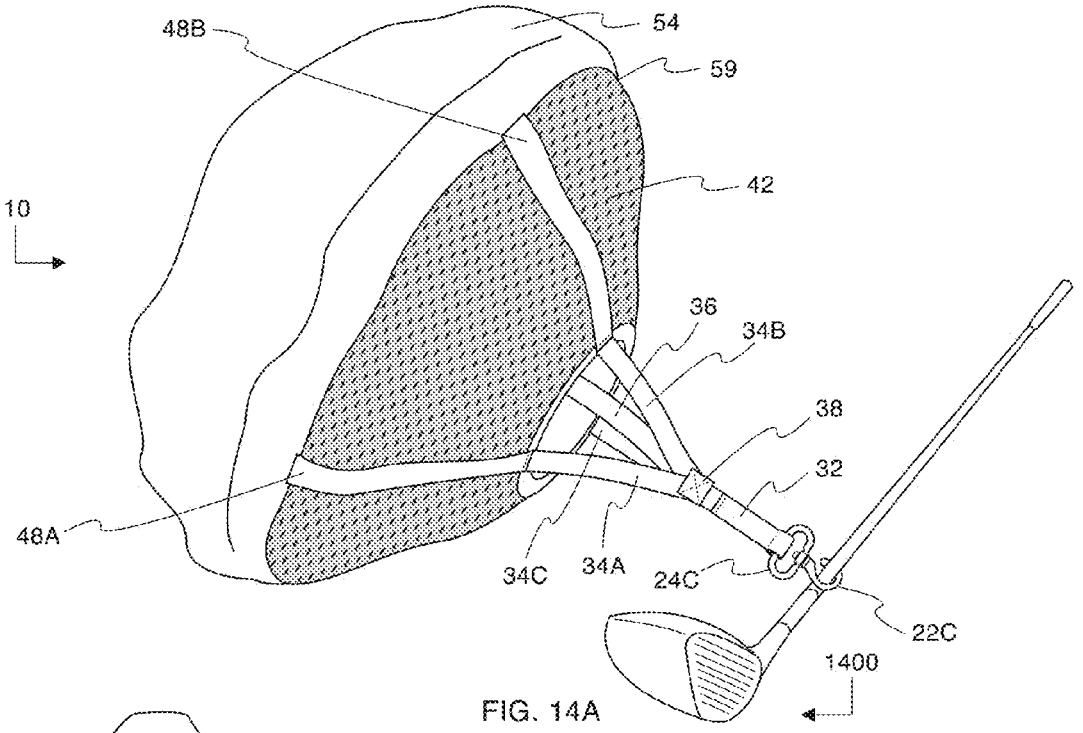
FIG. 14A shows a perspective view of one embodiment of a training unit configured to a golf club.
Figure 14B:
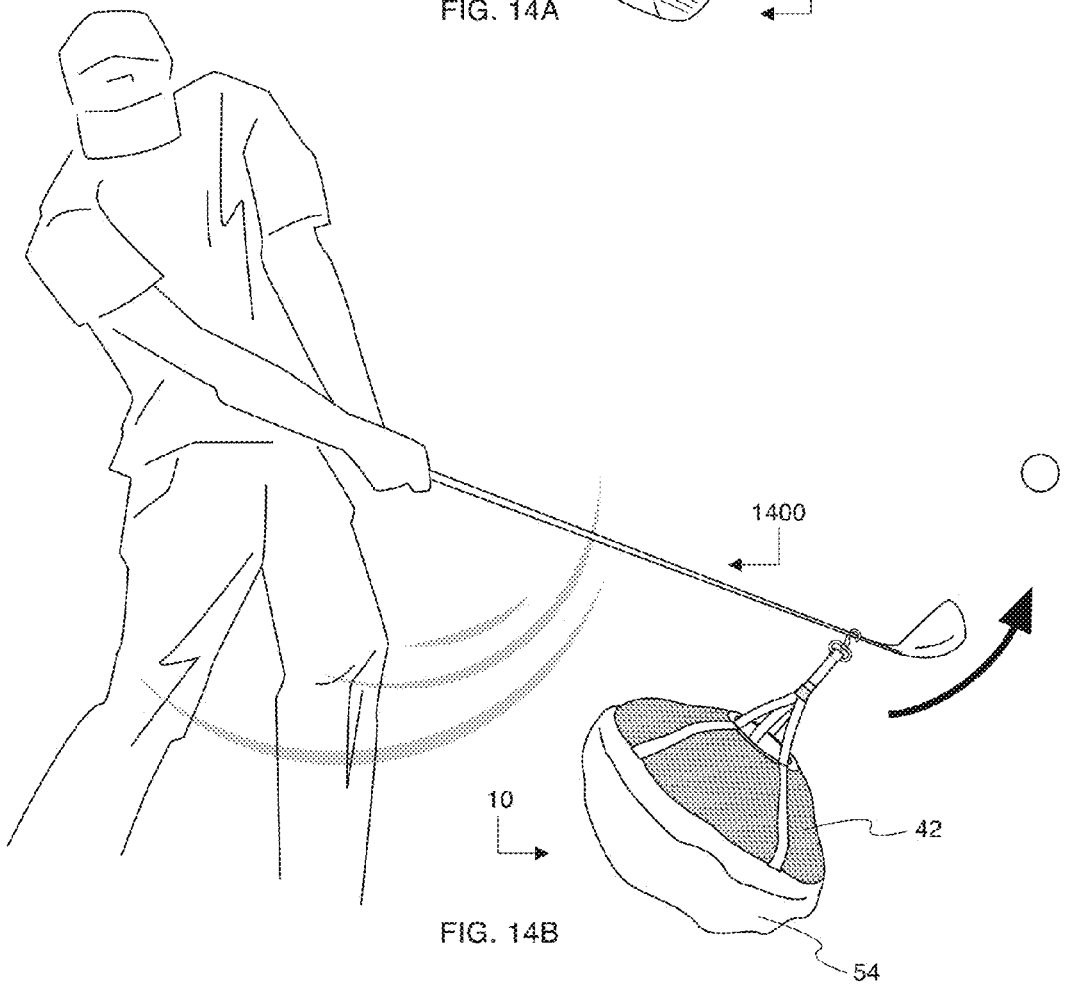
FIG. 14B shows one embodiment of a training unit configured to a golf club and being moved by a user in a desired motion.
Figure 15A:
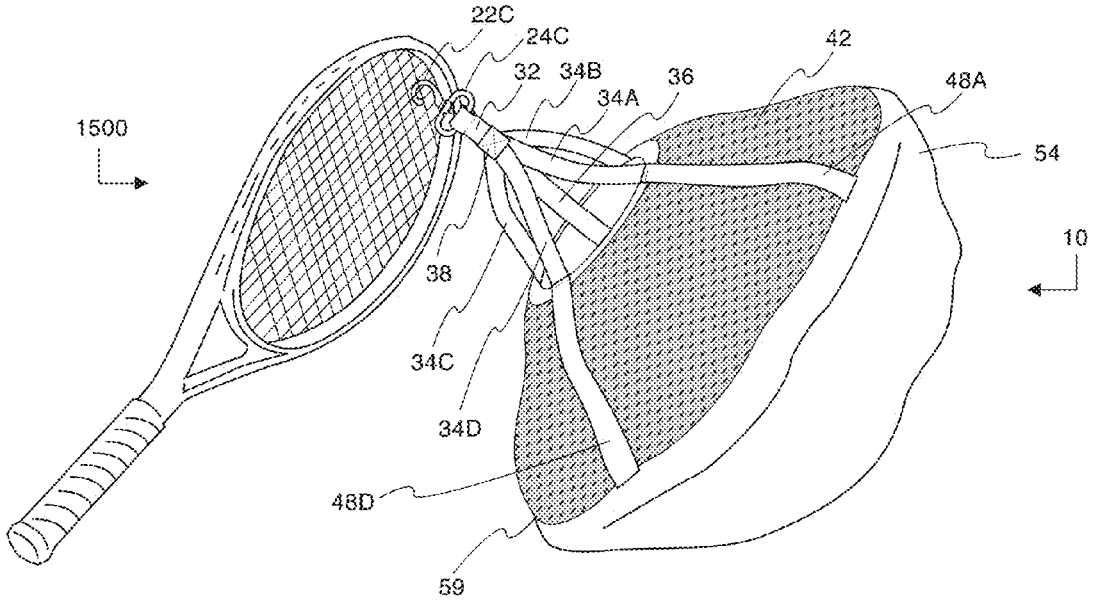
FIG. 15A shows a perspective view of one embodiment of a training unit configured to a tennis racket.
Figure 15B:
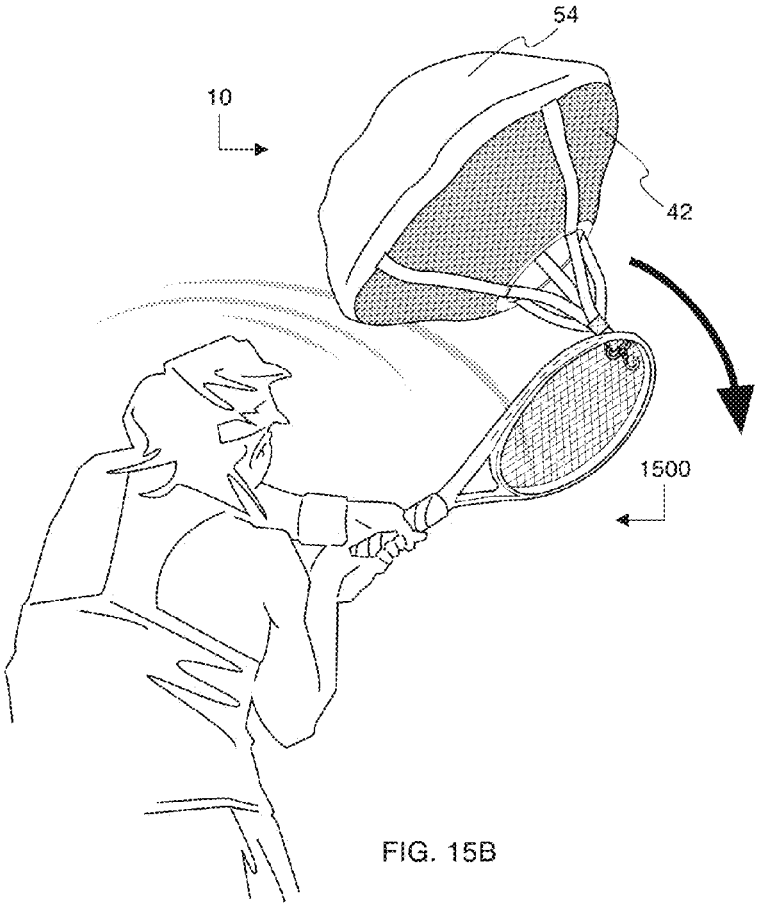
FIG. 15B shows one embodiment of a training unit configured to a tennis racket and being moved by a user in a desired motion.

In one or more embodiment, in step 1302, a user may enter method 1300 by at least obtaining training device 10 and a desired first device (such as, for example, a golf club 1400, as illustrated in FIGS. 14A and 14B, or a tennis racket 1500, as illustrated in FIGS. 15A and 15B, or a device as otherwise described herein).

In one or more embodiment, in step 1304, a user may configure training device 10 to the first device, such as, for example, by configuring training device 10 to the shaft of golf club 1400 or the racket or shaft of tennis racket 1500. In one or more embodiments, training device 10 may be configured to first device in various ways, by various means, methods and materials. For example, in one or more embodiments, as illustrated in FIGS. 14A, 14B, 15A and 15B, the attachment unit 20 of training device 10 may be configured with hook member 22C (which may include swivel 24C) which may be configured to the first device, such as, for example, the shaft of golf club 1400 or the racket or shaft of tennis racket 1500. Although not shown in FIGS. 14A, 14B, 15A and 15B, in one or more embodiments, attachment unit 20 may be configured with hook member 22B (which may include swivel 24B) or hook member 22A (which may include swivel 24A) and/or strap unit 26A, which may be configured to the first device.

In one or more embodiment, in step 1306, a user may move the first device with training device 10 configured to it in a desired motion and in as many repetitions as desired. In one or more embodiments, the force, speed, trajectory, posture, repetition, and other aspects of the desired motion may vary according to the activity the user is engaged in and/or according to the user's desired results.

For example, in one or more embodiments, as illustrated in FIG. 14A, a user may configure training device 10 to the shaft of golf club 1400 and then, as illustrated in FIG. 14B, a user may handle golf club 1400 and, with training device 10 attached, position his or her body to engage in a golf swing. In one or more embodiments, when a user initially configures training device 10 to golf club 1400 and/or engages in a back swing (although not shown in FIG. 14B), training device 10 may hang from and follow golf club 1400 and once golf club 1400 is swung in a forward motion, training device 10 may follow golf club 1400 and open up and catch air, and thus add resistance to the user's swing. The same principle may be applied and adapted, in one or more embodiments, by a user to virtually any type of golf swing. In one or more embodiments, the use of training device 10 as disclosed may increase the strength and speed of a user's swing, as well as benefit the user in some, none or all of the other ways associated with using the disclosure as described herein. Although FIG. 14B shows a user hitting a golf ball while swinging golf club 1400 with training device 10 attached, a user could also swing golf club 1400 with training device 10 attached without intending to strike a golf ball, such as, for example, while warming up before taking a shot.

In another example, in one or more embodiments, as illustrated in FIG. 15A, a user may configure training device 10 to the shaft or racket of tennis racket 1500 and then, as illustrated in FIG. 15B, a user may handle tennis racket 1500 and, with training device 10 attached, position his or her body to engage in a tennis racket swing. In one or more embodiments, when a user initially configures training device 10 to tennis racket 1500 and/or engages in a back swing, training device 10 may hang from and follow tennis racket 1500 and once tennis racket 1500 is swung in a the opposite motion, training device 10 may follow tennis racket 1500 and open up and catch air, and thus add resistance to the user's swing. The same principle may be applied and adapted, in one or more embodiments, by a user to virtually any type of tennis swing. In one or more embodiments, the use of training device 10 as disclosed may increase the strength and speed of a user's swing, as well as benefit the user in some, none or all of the other ways associated with using the disclosure as described herein. Although FIG. 15B shows a user swinging tennis racket 1500 with training device 10 attached without intending to strike a tennis ball, a user could also swing tennis racket 1500 with training device 10 attached while attempting to strike a tennis ball.

In one or more embodiment, in step 1308, a user may remove the training device from the first device. In one or more embodiment, in step 1310, method 1300 of using training device 10 may terminate.

FIG. 16 is a flow diagram that depicts one embodiment of a method 1600 for using training device 10 with hand unit 28. FIGS. 17A through 17E depict embodiments of aspects of implementing method 1600. The appearance, features, types, and configurations of the devices that may be used in conjunction with training device 10 are not limited to those illustrated in FIGS. 17A through 17E but may vary greatly while still remaining true to the spirit and principles of this disclosure.

Figure 17A:
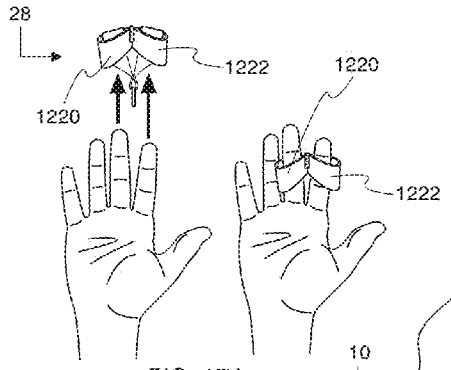
FIG. 17A shows a bottom view of one embodiment of inserting a user's fingers into a hand unit.
Figure 17B:
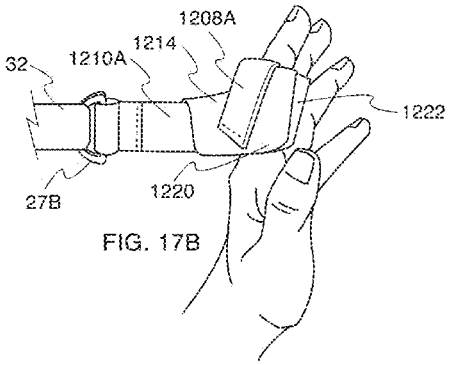
FIG. 17B shows a side view of one embodiment of a user's fingers inserted into a hand unit.
Figure 17C:
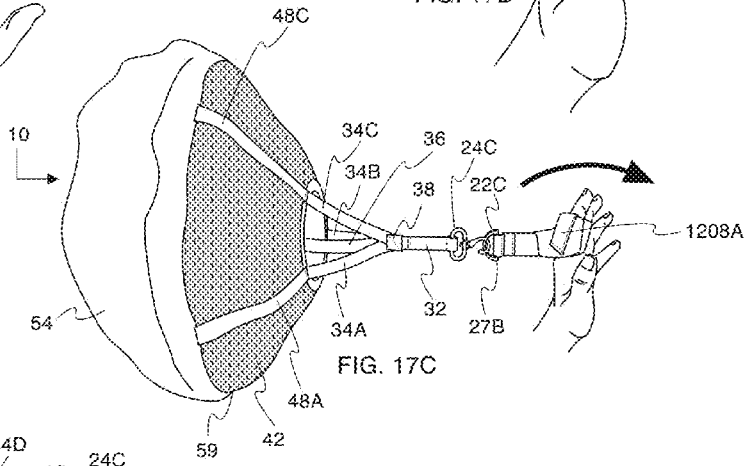
FIG. 17C shows one embodiment of a training unit configured to a hand unit and being moved by a user in a desired motion.

In one or more embodiment, in step 1602, a user may enter method 1600 by at least obtaining training device 10 and hand unit 28 (such as, for example, as illustrated in FIG. 17C). In one or more embodiments, a user may enter method 1600 by at least obtaining training device 10, hand unit 28, and the desired first device (such as, for example, a baseball 1700, as illustrated in FIG. 17D, or a football 1702, as illustrated in FIG. 17E, or as otherwise described herein).

In one or more embodiment, in step 1604, a user may configure hand unit 28 to training device 10. As indicated above, in one or more embodiment, a means for configuring hand unit 28 to training device 10 may be accomplished in a variety of ways, by a variety of means, methods and materials. For example, in one or more embodiments, hand unit 28 may be configured with d-ring 27B. In one or more embodiments, the attachment unit 20 of training device 10 may be configured with hook member 22C (which may include swivel 24C) which may be configured to d-ring 27B which may be configured to hand unit 28. Although not shown in FIGS. 17A through 17E, in one or more embodiments, attachment unit 20 may be configured with hook member 22B (which may include swivel 24B) or hook member 22A (which may include swivel 24A) which may be configured to d-ring 27B which may be configured to hand unit 28 or, alternatively and/or in addition, neck member 32 may be configured to d-ring 27B which may be configured to hand unit 28. In one or more embodiments, hand unit 28 may be used by a user's right or left hand.

In one or more embodiment, in step 1606, a user may insert at least one of the user's fingers into hand unit 28. In one or more embodiments, a user may insert any combination of or one or more fingers that the user desires, into the openings 1242, 1244 of hand unit 28, such as, for example, as illustrated in FIGS. 17A through 17E, a user's middle and index fingers or a user's ring and middle fingers, etc.

Figure 17D:
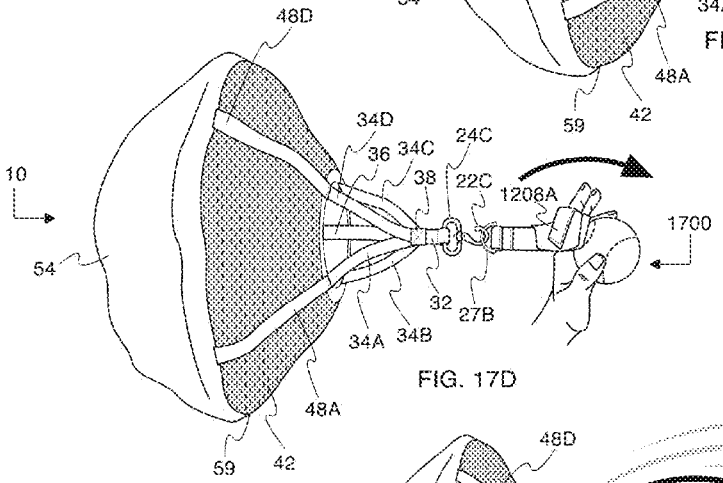
FIG. 17D shows one embodiment of a training unit configured to a hand unit, with a user engaging a baseball, and being moved by a user in a desired motion.
Figure 17E:
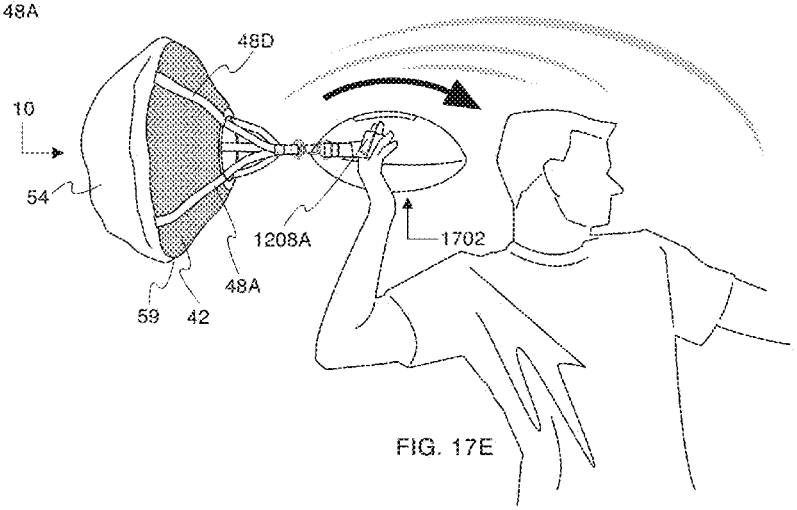
FIG. 17E shows one embodiment of a training unit configured to a hand unit, with a user engaging a football, and being moved by a user in a desired motion.

In one or more embodiment, in step 1608, a user may optionally engage the first device, such as, for example, a baseball 1700 (as illustrated in FIG. 17D) or a football 1702 (as illustrated in FIG. 17E), or a device as otherwise describe herein.

In one or more embodiment, in step 1610, a user may move hand unit 28 configured to training device 10 in a desired motion and in as many repetitions as desired, and optionally, while engaging the first device. In one or more embodiments, the force, speed, trajectory, posture, repetition, and all other aspects of the desired motion may vary according to the activity the user is engaged in and/or according to the user's desired results.

For example, in one or more embodiments, as illustrated in FIGS. 17A and 17B, a user may insert at least one of the user's fingers into hand unit 28 and then, as illustrated in FIG. 17C, a user may move hand unit 28 which may be configured to training device 10 in a desired motion (such as, for example, swing or throwing his or her arm) and in as many repetitions as desired (without engaging the first device), such as, for example, while warming up for throwing a ball or boxing or any other activity that involves a swinging or throwing or other motions. In one or more embodiments, when a user initially inserts his or her finger(s) into hand unit 28, training device 10 may hang from and follow the appendage(s) and once the user's arm is swung or thrown or engaged in another motion, training device 10 may follow the user's movement and open up and catch air, and thus add resistance to the user's swing or throw or other motion. The same principle may be applied and adapted, in one or more embodiments, by a user to virtually any type of swinging or throwing or other motion. In one or more embodiments, the use of training device 10 as disclosed may increase the strength and speed of a user's swing or throw or other motion, as well as benefit the user in some, none or all of the other ways associated with using the disclosure as described herein.

In another example, in one or more embodiments, as illustrated in FIGS. 17A and 17B, a user may insert at least one of the user's fingers into hand unit 28, and engage a baseball 1700, and then, as illustrated in FIG. 17D, a user may move hand unit 28 configured to training device 10 in a desired motion (such as, for example, throwing a baseball) and in as many repetitions as desired, while engaging baseball 1700. In one or more embodiments, the throwing or other motions may be performed while warming up. In one or more embodiments, when a user initially inserts his or her finger(s) into hand unit 28, training device 10 may hang from and follow the appendage(s) and once the user's arm is swung or thrown or otherwise moved, training device 10 may follow the user's movement and open up and catch air, and thus add resistance to the user's swing, throw or other motion. The same principle may be applied and adapted, in one or more embodiments, by a user to virtually any type of swing, throw or other motion. In one or more embodiments, the use of training device 10 as disclosed may increase the strength and speed of a user's swing, throw or other motion, as well as benefit the user in some, none or all of the other ways associated with using the disclosure as described herein.

In another example, in one or more embodiments, as illustrated in FIGS. 17A and 17B, a user may insert at least one of the user's fingers into hand unit 28, and engage a football 1702, and then, as illustrated in FIG. 17E, move hand unit 28 configured to training device 10 in a desired motion (such as, for example, throwing a football) and in as many repetitions as desired, while engaging football 1702. In one or more embodiments, the throwing or other motion may be performed while warming up. In one or more embodiments, when a user initially inserts his or her finger(s) into hand unit 28, training device 10 may hang from and follow the appendage(s) and once the user's arm is swung in throwing or other motion, training device 10 may follow the user's movement and open up and catch air, and thus add resistance to the user's throw or other motion. The same principle may be applied and adapted, in one or more embodiments, by a user to virtually any type of throwing or other motion. In one or more embodiments, the use of training device 10 as disclosed may increase the strength and speed of a user's throw or other motion, as well as benefit the user in some, none or all of the other ways associated with using the disclosure as described herein In one or more embodiment, in step 1612, a user may optionally release the first device. In one or more embodiment, in step 1614, a user may remove his or her fingers from hand unit 28. In one or more embodiment, in step 1616, a user may optionally remove hand unit 28 from training device 10. In one or more embodiment, in step 1618, method 1600 of using training device 10 may terminate.

FIG. 18 is a flow diagram that depicts one embodiment of a method 1800 for using training device 10 with strap units 26A and 26B. FIGS. 19A, 19B, 19C, 20A and 20B depict embodiments of aspects of implementing method 1800. The appearance, features, types, and configurations of the devices that may be used in conjunction with training device 10 are not limited to those illustrated in FIG. 19A, 19B, 19C, 20A or 20B but may vary greatly while still remaining true to the spirit and principles of this disclosure.

In one or more embodiments, strap units 26A, 26B may be configured to be used in any direction.

Figure 19A:
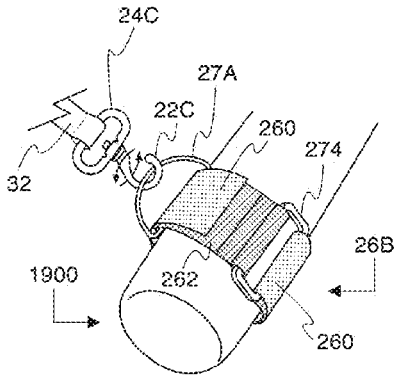
FIG. 19A shows one embodiment of a training unit configured to one embodiment of a strap unit which is engaging a baseball bat.
Figure 19B:
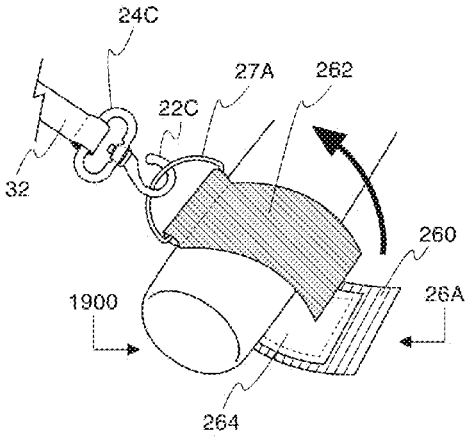
FIG. 19B shows one embodiment of a training unit configured to another embodiment of a strap unit which is engaging a baseball bat.
Figure 19C:
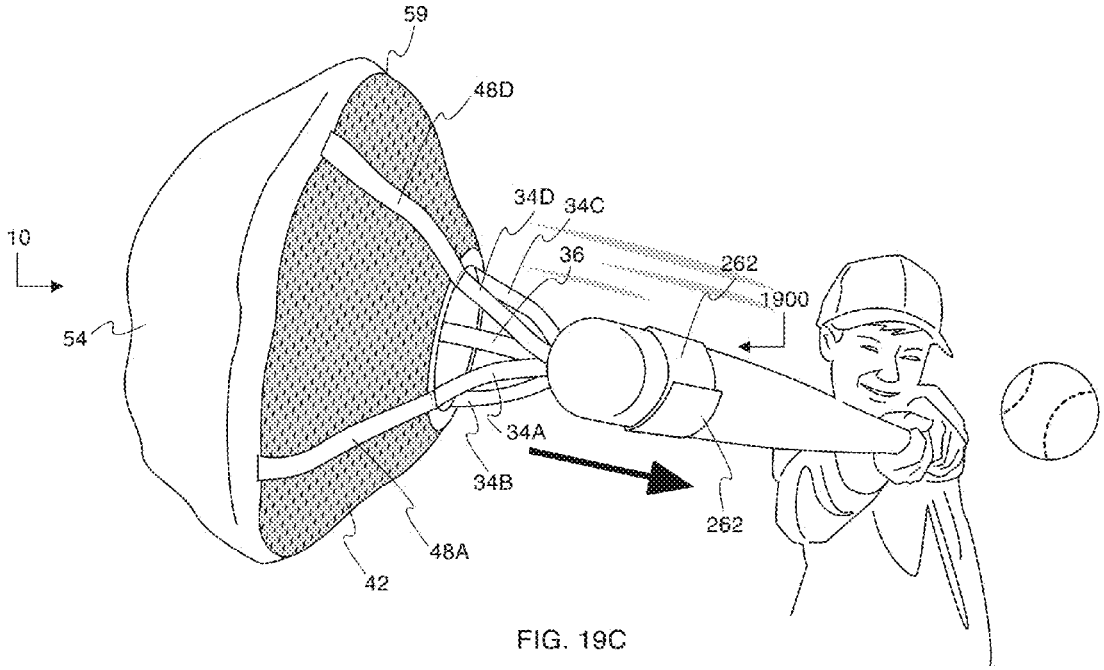
FIG. 19C shows one embodiment of a training unit configured to one embodiment of a strap unit which is engaging a baseball bat and being moved by a user in a desired motion.
Figure 20A:
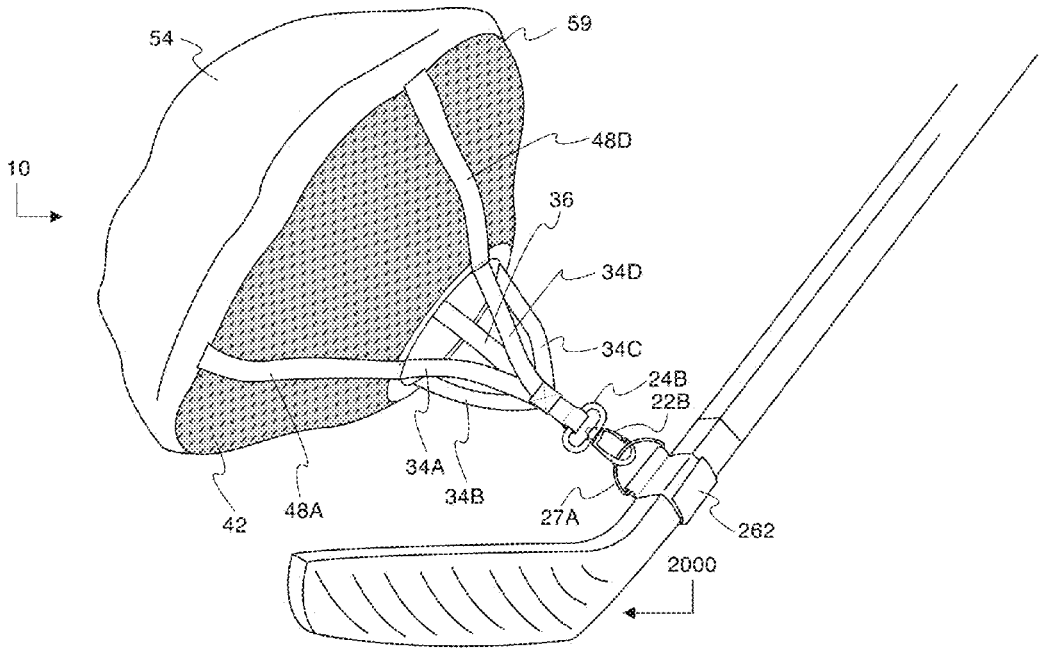
FIG. 20A shows a perspective view of one embodiment of a training unit configured to a strap unit which is configured to a hockey stick.
Figure 20B:
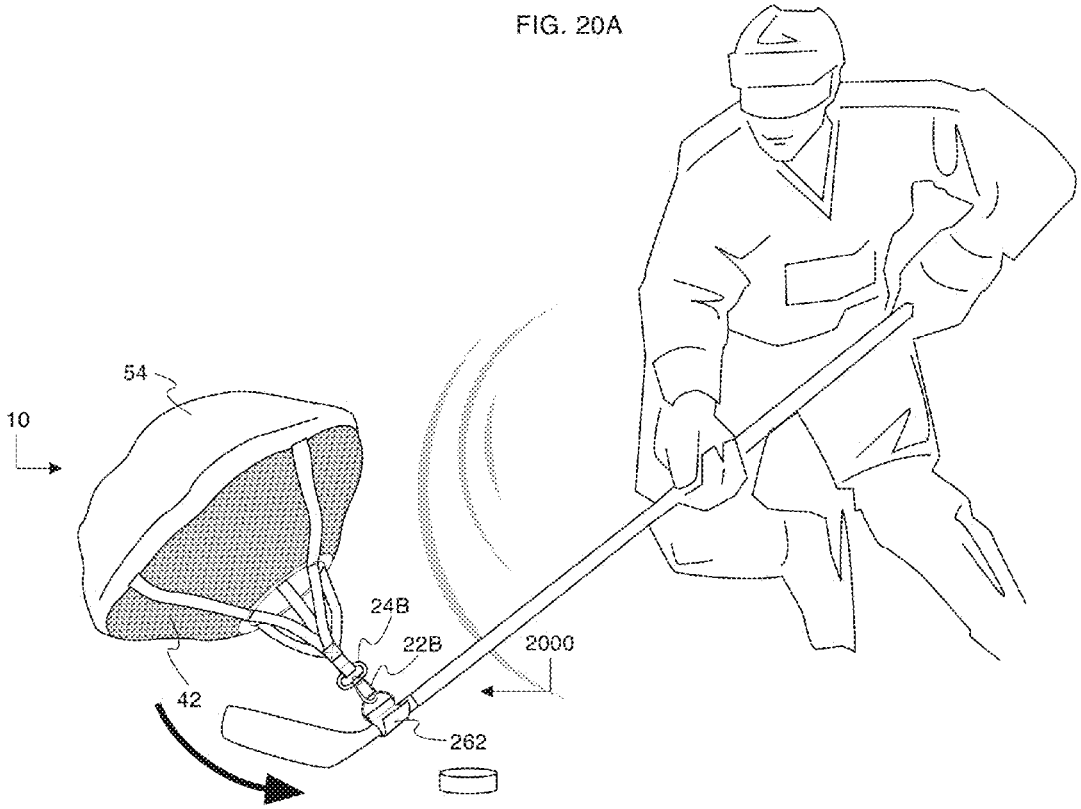
FIG. 20B shows one embodiment of a training unit configured to a strap unit which is engaging a hockey stick and being moved by a user in a desired motion.

In one or more embodiment, in step 1802, a user may enter method 1800 by at least obtaining training device 10, strap unit 26A or 26B, and the desired first device (such as, for example, a baseball bat 1900, as illustrated in FIGS. 19A, 19B and 19C, or a hockey stick 2000, as illustrated in FIGS. 20A and 20B, or a device as otherwise described herein).

In one or more embodiment, in step 1804, a user may configure strap unit 26A or 26B to training device 10. In one or more embodiment, the means for configuring strap units 26A, 26B to training device 10 may be accomplished in a variety of ways, by a variety of means, methods and materials.

For example, as illustrated in FIGS. 19A, 19B and 19C, in one or more embodiments, d-ring 27A may be configured to strap units 26A, 26B which d-ring 27A may be configured to hook member 22C (which may be configured with swivel 24C) which may be configured to neck member 32. In another example, as illustrated in FIGS. 20A and 20B, in one or more embodiments, d-ring 27A may be configured to strap units 26A, 26B which d-ring 27A may be configured to hook member 22B (which may be configured with swivel 24B) which may be configured to neck member 32.

Although not shown in FIG. 19A, 19B, 19C, 20A or 20B, in one or more embodiments, said means for configuring strap units 26A, 26B to training device 10 may include a d-ring 27A configured to strap units 26A, 26B which d-ring 27A may be configured to neck member 32 without a hook member. Although not shown in FIG. 19A, 19B, 19C, 20A or 20B, in one or more embodiments, attachment unit 20 may be configured with a variety of other means, methods and materials, such as, for example, hook member 22A (which may include swivel 24A) which may be configured to d-ring 27A which may be configured to strap units 26A, 26B.

In one or more embodiment, in step 1806, a user may configure strap unit 26A or 26B to the first device. In one or more embodiment, strap units 26A, 26B may be configured to the first device in a variety of ways, by a variety of means, methods and materials.

For example, in one or more embodiments, as illustrated in FIGS. 19B, 19C, 20A and 20B, strap unit 26A may include bottom surface 260 and top surface 262 which may be configured respectively with a loop type mechanism and a hook type mechanism or vice versa (such as, for example, felt or Velcro, including nylon Velcro, poly-plastic Velcro, poly-propylene Velcro, etc., including, single or double sided Velcro, or the like or other material). In one or more embodiments, bottom surface 260 may be configured to be releasably attachable to top surface 262 (such as, for example, is typical of conventional Velcro, felt-hook combination, or the like or other materials). In one or more embodiments, as illustrated in FIG. 19B, 19C, 20A or 20B, strap unit 26A may be configured to be capable of being opened for inserting first device into a loop, closed around first device, and re-opened for removal of first device. In one or more embodiments, as illustrated in FIG. 19B, strap unit 26A may include means 264 for gripping devices which may be configured with tactified rubber material for added ability to grip first device.

In another example, in one or more embodiments, as illustrated in FIG. 19A, strap unit 26B may include bottom surface 260 and top surface 262. In one or more embodiments, some portion 263A of top surface 262 may be configured to be releaseably attachable onto another portion 263B of top surface 262 (such as, for example, is typical of conventional Velcro, including nylon Velcro, poly-plastic Velcro, poly-propylene Velcro, etc., including, single or double sided Velcro, or felt-hook combination, or the like or other materials). In one or more embodiments, strap unit 26B may be configured to be capable of being opened for inserting first device into a loop, closed around first device, synched, and re-opened for removal of first device. Although not shown in FIG. 19A, in one or more embodiments, strap unit 26B may include means 264 for gripping devices which may be configured with tactified rubber material which may be sewn onto strap unit 26B. In one or more embodiments, strap unit 26B may be configured with a means for synching strap unit 26B to first device, which may include and be accomplished by various devices (such as, for example, buckles, hooks, rings, clasps, chains, snaps, clips, etc.) which may work in conjunction with various materials (such as, for example, felt or Velcro or other materials). For example, in one or more embodiments, strap unit 26B may be configured with a means 274 for synching strap unit 26B to first device, which may include rounded rectangular ring that may be configured to one end of strap unit 26B and able to receive and allow the other end of strap unit 26B to pass through and around the ring and be attached, secured, or otherwise configured back on itself (see FIG. 11C).

Although not shown in FIG. 19A, 19B, 19C, 20A or 20B, in one or more embodiments, a user may configure strap units 26A, 26B to his or her or another's appendages, such as, for example, fingers, hands, arms, etc.

In one or more embodiments, a user may perform step 1806 before step 1804.

In one or more embodiment, in step 1808, a user may move first device with strap unit 26A or 26B configured to it in a desired motion and in as many repetitions as desired. In one or more embodiments, the force, speed, trajectory, posture, repetition, and all other aspects of the desired motion may vary according to the activity the user is engaged in and/or according to the user's desired results.

For example, in one or more embodiments, as illustrated in FIGS. 19A and 19B, a user may configure strap unit 26A or 26B to training device 10 and a baseball bat 1900, and then, as illustrated in FIG. 19C, handle baseball bat 1900 and, with strap unit 26A or 26B (which may be configured to training device 10) attached, a user may position his or her body to engage in a baseball swing. In one or more embodiments, when a user initially configures strap unit 26A or 26B (which may be configured to training device 10) to baseball bat 1900 and/or engages in a back swing (although not shown in FIG. 19C), training device 10 may hang from and follow baseball bat 1900 and once baseball bat 1900 is swung in a forward motion, training device 10 may follow the user's swing and open up and catch air, and thus add resistance to the user's swinging motion. The same principle may be applied and adapted, in one or more embodiments, by a user to virtually any type of swinging motion. In one or more embodiments, user may swing baseball bat 1900 with strap unit 26A or 26B configured to it (which may be configured to training device 10) in as many repetitions as desired. In one or more embodiments, the use of training device 10 as disclosed may increase the strength and speed of a user's swing, as well as benefit the user in some, none or all of the other ways associated with using the disclosure as described herein. Although FIG. 19C shows a user hitting a baseball ball while swinging baseball bat 1900 with strap unit 26A attached to it (which may be configured to training device 10), a user could also swing baseball bat 1900 without intending to strike a baseball ball, such as, for example, while warming up.

In another example, in one or more embodiments, as illustrated in FIG. 20A, a user may configure strap unit 26A or 26B (although not illustrated in FIG. 20A) to training device 10 and a hockey stick 2000, and then, as illustrated in FIG. 20B, user may handle hockey stick 2000 and, with strap unit 26A or 26B attached (which may be configured to training device 10), position his or her body to engage in a hockey stick swing. In one or more embodiments, when a user initially configures strap unit 26A or 26B (which may be configured to training device 10) to hockey stick 2000 and/or engages in a back swing (although not shown in FIG. 20B) training device 10 may hang from and follow hockey stick 2000 and once hockey stick 2000 is swung in a forward motion, training device 10 may follow the user's swing and open up and catch air, and thus add resistance to the user's swinging motion. The same principle may be applied and adapted, in one or more embodiments, by a user to virtually any type of swinging motion. In one or more embodiments, user may swing hockey stick 2000 with strap unit 26A or 26B configured to it (which may be configured to training device 10) in as many repetitions as desired. In one or more embodiments, the use of training device 10 as disclosed may increase the strength and speed of a user's swing, as well as benefit the user in some, none or all of the other ways associated with using the disclosure as described herein. Although FIG. 20B shows a user hitting a hockey puck while swinging hockey stick 2000 with strap unit 26A attached to it (which may be configured to training device 10), a user could also swing hockey stick 2000 without intending to strike a hockey puck, such as, for example, while warming up.

In one or more embodiment, in step 1810, a user may remove strap units 26A or 26B from first device. In one or more embodiment, in step 1812, a user may optionally remove strap units 26A or 26B from training device 10. In one or more embodiment, in step 1814, method 1800 of using training device 10 may terminate.

Different embodiments of the disclosure may implement the above scenario and/or variations of the above scenario.

In one or more embodiment, any of the structures, functions, and/or features of any device described herein may be combined with any of the structures, functions, and/or features of any other disclosure herein.

In one or more embodiments, each component of the disclosures may be provided in virtually an unlimited number of colors.

In one or more embodiments, other modifications may be made to the embodiment illustrated in the drawings or otherwise disclosed herein or equivalents, which may include and/or have the capacity to utilize abilities, systems, devices, means, functionality, features, methods and/or uses not expressly and/or impliedly described herein and/or illustrated in the drawings to this application but which may be obvious to one skilled in the art, whether developed later or known at the time of filing.

It should be understood that the present systems, apparatuses, devices, means, methods and structures are not intended to be limited to the particular forms disclosed; rather, they are to cover all combinations, modifications, equivalents, and alternatives. A system, apparatuses, devices, means, methods or structure that is configured in a certain way is configured in at least that way, but may also be configured in ways that are not described or illustrated. The disclosure may be configured to function with a variety of systems, apparatuses, devices, methods, means, and structures. Different materials may be used for individual components. Different materials may be combined in a single component.

The present disclosure may be embodied in other specific forms without departing from its spirit or essential characteristics. It is appreciated that various features of the above described examples and embodiments may be mixed and matched to form a variety of other combinations and alternatives. It is also appreciated that systems and method disclosed herein should not be limited simply to training devices, methods and systems. As such, the described embodiments are to be considered in all respects as illustrative and not restrictive. Other embodiments and/or implementations are within the scope of the following claims and at least all changes which come within the meaning and range of equivalency of the claims are to be embraced within their scope. The scope of the invention may be indicated by the appended claims rather than by any of the foregoing description.

What is claimed is:

1. A training device, comprising:

an attachment unit comprising a swivel;

a plurality of support members;

a first member comprising an opening through which air may pass when the training device is in motion;

a second member operably connected to the first member, wherein the second member inflates and provides wind resistance when the training device is in motion;

wherein the plurality of support members operably connect the first member to the attachment unit;

wherein at least one of the plurality of support members passes through the opening to operably connect the second member to the attachment unit; and wherein the opening is reinforced with reinforcement material and stiffening material.

2. The training device of claim 1, wherein the plurality of support members comprising at least three support legs.

3. The training device of claim 2, wherein the plurality of support members further comprising:

a neck member; and a chute support member.

4. The training device of claim 3, wherein at least one of the at least three support legs, the neck member, and the chute support member is configured from at least one of the following materials: polypropylene nylon binding tape, nylon blend woven webbing, polypropylene, nylon, nylon blend, cotton, nylon-woven, polyester, elastic, rubber and jacquard.

5. The training device of claim 3, wherein at least a portion of the neck member is doubled backed on itself to provide reinforcement.

6. The training device of claim 3, wherein the second member comprising a top portion and a bottom portion; wherein the chute support member is operably connected to the top portion of the second member for supporting the second member when the training device is in motion.

7. The training device of claim 3, wherein the second member further composing a top portion and a bottom portion; wherein reinforcement material is operably connected to the top portion of second member; wherein the chute support member is operably connected to the reinforcement material for supporting the second member when the training device is in motion.

8. The training device of claim 2, wherein the plurality of support members further comprising at least three support members.

9. The training device of claim 8, wherein the first member further comprising a top portion and a bottom portion; wherein the at least three support members are operably connected to the top portion of the first member.

10. The training device of claim 2, wherein the first member is configured from at least one of the following materials: nylon football mesh, woven nylon football mesh, fabric football mesh, polyester mesh, cotton football mesh, cotton-poly football mesh, double knit mesh, air-wick mesh, dazzle mesh, moisture wicking polyester mesh, dazzle cloth polyester, and air wicking hybrid mesh.

11. The training device of claim 2, wherein the first member is configured to be between about 12 inches to about 20 inches wide.

12. The training device of claim 2, wherein the second member is configured from at least one of the following materials: nylon rip stop, cotton rip stop, polyester rip stop, woven rip stop, silk rip stop, and polypropylene.

13. The training device of claim 2, wherein the second member is configured from material that includes cross-hatched threading.

14. The training device of claim 2, wherein the attachment unit further comprising a hook member.

15. The training device of claim 2, wherein the first member is configured to be between about 26 inches to about 34 inches width.

16. The training device of claim 1, wherein the plurality of support members comprising at least four support legs.

17. The training device of claim 1, wherein the attachment unit operably connects to a hand unit; wherein the hand unit comprising at least two strap members, a handle member, and a reinforcement member.

18. The training device of claim 1, wherein the attachment unit is removably connected to a first device.

* * * * *